US006783038B2

(12) United States Patent
Xu et al.

(10) Patent No.: US 6,783,038 B2
(45) Date of Patent: Aug. 31, 2004

(54) SLIDING GATE FOR LIQUID METAL FLOW CONTROL

(75) Inventors: Dong Xu, Ontario (CA); Lawrence J. Heaslip, Ontario (CA); James D. Dorricott, Ontario (CA)

(73) Assignee: Vesuvius Crucible Company, Wilmington, DE (US)

( * ) Notice: Subject to any disclaimer, the term of this patent is extended or adjusted under 35 U.S.C. 154(b) by 54 days.

(21) Appl. No.: 10/221,516

(22) PCT Filed: Mar. 16, 2001

(86) PCT No.: PCT/US01/08795

§ 371 (c)(1),
(2), (4) Date: Sep. 13, 2002

(87) PCT Pub. No.: WO01/68296

PCT Pub. Date: Sep. 20, 2001

(65) Prior Publication Data

US 2003/0205354 A1 Nov. 6, 2003

Related U.S. Application Data

(60) Provisional application No. 60/189,820, filed on Mar. 16, 2000.

(51) Int. Cl.[7] ..... B22D 41/08

(52) U.S. Cl. ..... 222/590; 222/600

(58) Field of Search ..... 222/590, 600, 222/597; 164/437, 435

(56) References Cited

U.S. PATENT DOCUMENTS

| | | | | |
|---|---|---|---|---|
| 4,966,315 A | | 10/1990 | Tinnes et al. | |
| 5,062,553 A | * | 11/1991 | King | 222/600 |
| 5,518,154 A | | 5/1996 | Vassilicos et al. | |

FOREIGN PATENT DOCUMENTS

| | | | | |
|---|---|---|---|---|
| DE | 2014331 A | | 3/1972 | |
| JP | 356105862 A | * | 8/1981 | 222/600 |

* cited by examiner

*Primary Examiner*—Scott Kastler
(74) *Attorney, Agent, or Firm*—James R. Williams; Robert S. Klemz, Jr.

(57) ABSTRACT

A metering gate for liquid metal flow control with reduced clogging with a top plate, having a first flow channel bore with an inlet having an inlet axis and an outlet having an outlet axis. The inlet axis and the outlet axis are offset. A throttle plate slidably mounted on the top plate selectably receives flow from the top plate. The metering gate provides a less tortuous and more symmetrical flow path when the gate is partially open, but provides a relatively straight downward flow channel allowing full flow when the gate is fully open.

30 Claims, 19 Drawing Sheets

SLIDING GATE FOR LIQUID METAL FLOW CONTROL

This application claims the benefit of Provisional Application 60/189,820 filed Mar. 16, 2000.

BACKGROUND OF THE INVENTION

1. Field of the Invention

The invention relates to metal founding. More specifically, the invention relates to a method and apparatus for metering liquid metal during metal founding.

2. Description of the Related Art

Metering gates with three plates are used to control the rate of liquid metal flow exiting a teeming vessel, such as a tundish. For example, a metering gate may be used to control the rate of liquid steel flowing from the tundish of a continuous casting machine into a mold.

A metering gate consists of an assembly of refractory components, each of which has a flow channel. The flow channels (i.e. the holes or bores) within the refractory components are assembled together so as to provide a complete flow channel through the gate, which is in fluid communication with the teeming vessel and through which the liquid metal may be allowed to flow.

The refractory components of the metering gate are assembled and clamped together by mechanical means such that one component, a throttle plate, can slide laterally in the metering gate assembly to control the rate of liquid metal flow through the gate. By sliding the throttle plate to various positions, the gate may be either closed, partially open, or fully open to control the rate of flow exiting the teeming vessel.

Several problems are typically associated with controlling the flow of liquid steel exiting a tundish with metering gates. These problems include: (1) bending of metal flow in the flow channels of the gate, which can cause excessive turbulence and asymmetrical discharge of liquid metal; (2) severe non-uniform plugging of the flow channels from the accumulation of metallic and non-metallic materials which adhere to the channel walls with a subsequent loss of ability to obtain the desired rate and smoothness of liquid metal discharge; and (3) localized and accelerated eroding of a refractory component of the metering gate with subsequent contaminating of the liquid metal and potential loss of control or metal leakage.

Referring to FIGS. 1 and 2, a three-plate metering gate assembly 10 (hereinafter "gate 10") typically consists of five basic components: a well nozzle 20, a top plate 30, a throttle plate 40, a bottom plate 50 and an outlet tube 60. Liquid metal (not shown) flows into gate 10 at the top and flows out of gate 10 at the bottom.

The well nozzle 20 is a pipe, which allows the entry of liquid metal flowing from the teeming vessel (not shown) into a flow channel bore 22 at the top of the well nozzle 20. The top plate 30 is in contact with the bottom of well nozzle 20, and includes a flow channel bore 32. The central axis 35 of the flow channel bore 32 in top plate 30, as shown in FIG. 2, is collinear with central axis 25 of flow channel bore 22 in well nozzle 20.

Throttle plate 40 is in contact with the bottom of top plate 30. Gate 10 is designed so that throttle plate 40 may slide laterally relative to the other components of gate 10. Bottom plate 50 is in contact with the bottom of throttle plate 40, and includes a flow channel bore 52. Central axis 55 of flow channel bore 52 in bottom plate 50 is collinear with central axis 25 of flow channel bore 22 in well nozzle 20.

Outlet tube 60 is in contact with the bottom of bottom plate 50, and includes a flow channel bore 62. Central axis 65 of flow channel bore 62 in outlet tube 60 is collinear with central axis 25 of flow channel bore 22 in well nozzle 20.

Central axes 25, 35, 55 and 65 of flow channels 22, 32, 52 and 62 in well nozzle 20, top plate 30, bottom plate 50 and outlet tube 60, respectively, are collinear and all together define the "main central axis" 15 of gate 10.

As shown in FIGS. 3–5, throttle plate 40 slides between fully open (FIG. 3), partially open (FIG. 4) and gate closed (FIG. 5) positions. As shown in FIG. 4, during normal operations, throttle plate 40 typically is placed in a partially open position so that the flow rate of liquid metal through gate 10 may be metered, i.e., set and controlled, at a desired rate. As shown in FIG. 3, throttle plate 40 assumes a fully open position to maximize the flow of liquid metal through gate 10. As shown in FIG. 5, throttle plate 40 may assume a closed position, which would stop the flow of liquid metal through gate 10.

Metering gate components may be combined or subdivided. For example, to reduce the number of components, a gate 710 may be composed of only three parts, as shown in FIG. 6, in which the well nozzle may be combined with the top plate, defining a first component 712, and/or the bottom plate may be combined with the outlet tube, defining a second component 714, selectively placed in fluid communication with a throttle plate 740. As shown in FIG. 7, to more easily replace the outlet tube of a gate 810 having a well nozzle 812, a throttle plate 813 and a bottom plate 814, the bottom plate 814 may be divided into two plates 816 and 818.

Several variations of the fundamental three-plate gate components are used. For example, unlike the gate shown in FIGS. 1–5, in which well nozzle 20 has a tapered conical section bore 22 and bores 32 and 52 in plates 30 and 50 and bore 62 of outlet tube 60 define simple cylinders, as shown in FIG. 8, a gate 110 may have a well nozzle 120 with a cylindrical bore 122 and a top plate 130 with a conical bore section 132 with the bores in the throttle plate 140, the bottom plate 150 and the outlet tube 160 being the same as in the gate 110 of FIGS. 1–5. Also, as shown in FIG. 9, a gate 210 may have conical bore sections 222 and 232 in both well nozzle 220 and top plate 230 with the bores in the throttle plate 240, the bottom plate 250 and the outlet tube 260 being the same as in the gate 110 of FIGS. 1–5, and, as shown in FIG. 10, a gate 310 may have a well nozzle 320 having parabolically-shaped bore 322 and a top plate 330 having a conically-shaped bore 332 with the bores in the throttle plate 340, the bottom plate 350 and the outlet tube 360 being the same as in the gate 110 of FIGS. 1–5.

FIG. 11 illustrates another variation of a gate 410 where cylindrical bore 442 in throttle plate 440 is canted at an angle to plate surface 443 in an attempt to direct the flow through throttle plate 440 back toward main central axis 415 of gate 410. FIGS. 12 and 13 illustrate partially open and gate closed positions, respectively, of gate 410.

In gate 410, bores 422, 432, 442, 452 and 462 in well nozzle 420, top plate 430, throttle plate 440, bottom plate 450, and outlet tube 460, respectively, generally are axisymmetrical. For example, the bores have either cylindrical or conical section geometry. The central axis 425, 435, 455 and 465 of well nozzle 420, top plate 430, bottom plate 450, and outlet tube 460 generally are collinear.

Other variations of metering gates have been developed to provide for better draining of the throttle plate when it is closed. For example, FIGS. 14–16 show a gate 510, including a well nozzle 520, a top plate 530, throttle plate 540, bottom plate 550, and outlet tube 560, in open, partially open and closed gate positions, respectively. Gate 510 is similar to that of FIGS. 1–5 except that throttle plate flow channel bore 542 is extended by a special drain cut 544 near bottom edge 546 on one side to allow draining of bore 542 when the gate is in the closed position, as shown in FIG. 16. This prevents trapping of liquid metal in throttle plate bore 542 which otherwise would solidify when the gate 510 is temporarily closed.

FIGS. 17–19 show another gate 610, including a well nozzle 620, a top plate 630, throttle plate 640, bottom plate 650, and outlet tube 660, in open, partially open and closed gate positions, respectively, which provides another drainage feature. A conical bore section 652, at the top of bottom plate 650, has a diameter at top surface 654 of bottom plate 650 that is larger than the diameter of bore 652 at bottom surface 656 of bottom plate 650.

Unfortunately, the foregoing gate designs all provide a tortuous liquid metal flow path when the gate is partially open—the normal operating position during liquid metal pouring. Metering gates are designed with a maximum flow rate, but are intended to operate at about 50% of that rate. This assures the desired gate control response and affords excess capacity, which occasionally may be required for high-production or large section casting. Thus, a partially open gate is typical during liquid metal pouring, because the size of the flow channel must be large enough to provide a sufficient opening to accommodate a maximum rate of flow of the casting, but typically a gate is operated at less than maximum flow. The required or desired amount of liquid metal flow through the nozzle typically varies during the casting operation and generally is significantly less than the maximum, ranging from 30% to 70% of the maximum most of the time. As a result, the bent and contorted flow path formed in these gates when partially open causes: (1) asymmetric discharge of the liquid metal; (2) excessive turbulence in the flow channel; (3) localized regions which can be subject to accelerated erosion of refractory material; (4) over-restriction of the flow; and (5) rapid build-up of clogging in critical locations of the flow channel. The net effect is to shorten the useful life of the gate components and increase operating cost.

The distorted flow generated by these gates when partially open is illustrated schematically in FIGS. 20 and 21 with gates 210 (FIG. 9) and 410 (FIGS. 11–13) respectively. In FIG. 20, flow 271 in flow channel 212 impacts upper ledge 248 of throttle plate 240 (at Region A) which bends this portion of flow 271 sharply toward the opening of bore 242. Flow 272, which is the remaining portion of the flow, is bent to a much lesser degree. This mainly one-sided bending of the flow causes a flow 273 to separate from the surface of throttle plate bore 242 below the top edge 248 thereof and to be redirected toward bore 242. A high velocity jet flow 274 formed in throttle plate bore 242 is tilted strongly away from main central axis 215 of flow channel 212. This tilted jet impinges upon one side of bore 252 in bottom plate 250 (Region B) and feeds fluid into recirculating flow 275 under the ledge formed by the plate 230. The severe bending and tilting of the flow described above produces an asymmetrical flow pattern in bottom plate 250 and outlet tube 260 with: (1) a high speed flow 276 confined to one side of flow channel 212; and (2) an extensive recirculating flow 277, including very turbulent portions 278 and 279 which occupy the major portion of flow channel 212.

This flow behavior is deficient because it leads to excessive pressure loss and promotes clogging and erosion. The strong bending and tilting of the flow and its impingement on the refractory material (e.g. at Regions A & B), over-restricts the flow and the discharge of liquid metal is more easily impeded by any build-up of clogging material. Recirculating flow 275 is fed with incoming fluid providing ideal conditions for the build-up of non-metallic clogging material in bore 242 of throttle plate 240, which is a critical problem for gate performance. The asymmetrical nature of the flow in the outlet tube 260, with a concentrated jet 277 on one side and turbulent recirculation 279 on the other side, causes: (1) asymmetrical discharge of liquid metal from outlet tube 260, which can detrimentally affect cast metal quality; and (2) non-uniform and rapid clogging of outlet tube 260. Impingement of the flow on the sides of bore 252, such as in Region B, also aggravates problems with localized refractory erosion.

Referring to FIG. 21, one attempt to direct the flow back toward main central axis 415 of gate 410 fails and even exacerbates problems related to the tortuous flow path and the asymmetrical nature of flow distribution when gate 410 is partially open. FIG. 21 shows the flow pattern related to gate 410 having a canted cylindrical bore 442 in throttle plate 440 and a conical section bore 452 in bottom plate 450. The flow pattern is similar to, but more asymmetrical than, the flow of FIG. 20. Specifically, canted-throttle-bore flow 471 is bent more sharply where it impacts above top ledge 446 of throttle plate 440 (Region A), while flow 472 is bent much less than flow 471. This is because, comparing FIGS. 20 and 21, with a canted cylindrical bore 442, the entry of bore 242 essentially is shifted rightwardly, effectively presenting a longer ledge 446 which urges the flow 471 more orthogonal relative to the main central axis 415 than flow 271 interacting with a smaller top ledge.

The canting of bore 442 in throttle plate 440 also promotes a larger region of separated flow 473, as compared to FIG. 20, on one side of bore 242 in throttle plate 240. High velocity flow 474 is tilted more severely away from main central axis 415 of gate 410 which impinges more directly on one side of bottom plate bore 452 (Region B). Increased direct impingement of the jet increases the proportion of recirculating flows 475 and 476 under top plate ledge 446 and increases the confinement of high speed flow 477 entering outlet tube 460 to one side of flow channel 462. Subsequently, there is an increase in the extent of turbulent flow 478, 479 and 480 on the other side of flow channel 462. Thus, discharge is over-restricted and flow asymmetry entering outlet tube 460 is more severe, promoting clogging and erosion.

Accordingly, metering gate designs which attempt to improve flow symmetry by angling or canting the flow channel in the throttle plate to direct the flow back toward the main central axis of the gate when the gate is partially open are deficient and can cause greater problems during operation.

The foregoing demonstrates a need for a metering gate that promotes a straight liquid metal flow path.

SUMMARY OF THE INVENTION

The invention provides a method and apparatus for metering flow including selectively passing fluid through a passage in a top plate, having an inlet and an outlet, wherein the inlet and the outlet are offset, then into a throttle plate.

The invention provides for a metering gate which promotes a straighter liquid metal flow path and a more symmetrical and less turbulent discharge, thereby reducing the potential for clogging and erosion of the gate components.

The invention provides for a reduction in the extent of separated and turbulent flow regions when the gate is partially open. The invention provides for less erosive flow behavior. The invention provides for less restriction when partially open, thereby allowing easier passage of the liquid metal. The invention provides for fewer clogging problems by retarding the rate of build-up, reducing the extent of build-up and improving the uniformity of any build-up. The invention provides for improved uniformity of flow distribution in the outlet tube, thus improved metal flow behavior in a downstream vessel, such as a continuous casting mold. The invention provides for easier draining of the throttle plate without detrimental effect on flow behavior. The invention provides improved elements and arrangements thereof, for the purposes described, which are dependable and effective in accomplishing intended purposes of the invention.

BRIEF DESCRIPTION OF THE DRAWINGS

The invention is described in detail below with reference to the following figures, throughout which similar reference characters denote corresponding features consistently, wherein.

DETAILED DESCRIPTION OF THE PREFERRED EMBODIMENTS

The present invention is directed to a metering gate for liquid metal flow control with reduced clogging, including a top plate that provides an offset between one axis of the flow channel in the top plate and the main central axis of the gate.

Referring to FIGS. 22–28, a first embodiment of the present metering gate 1010 includes a well nozzle 1020, a top plate 1030, a throttle plate 1040, a bottom plate 1050, and an outlet tube 1060. A flow channel bore 1022 in well nozzle 1020 may have a conical section, but other configurations may be used. Flow channel bores 1042 and 1052 in throttle plate 1040 and bottom plate 1050 are shown as simple cylinders, but other shapes may be used. Similarly, flow channel bore 1062 in outlet tube 1060 is shown as a cylinder, but other shapes may be used.

Figure 23:
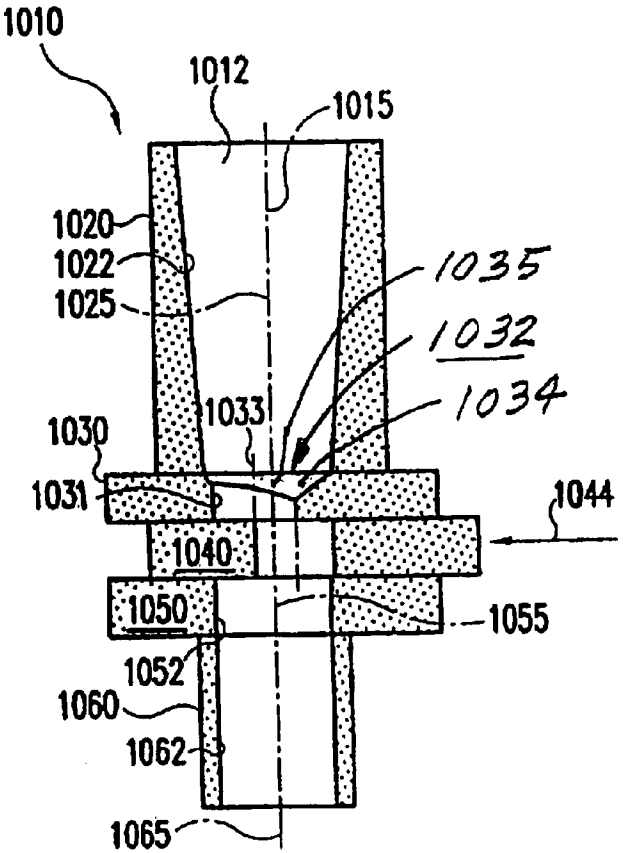
FIG. 23 is a cross-sectional detail view, drawn along line XXIII—XXIII in FIG. 22.

As shown in FIG. 23, flow channel bores 1022, 1052 and 1062 of well nozzle 1020, bottom plate 1050, and outlet tube 1060, respectively, include central axes 1025, 1055, 1065 which are collinear and define a main central axis 1015. Flow channel bore 1032 of top plate 1030 has an inlet with an inlet axis 1035 that is collinear with the main central axis 1015 and an outlet with an outlet axis 1033. Outlet axis 1033 is not collinear with inlet axis 1035.

Figure 25:
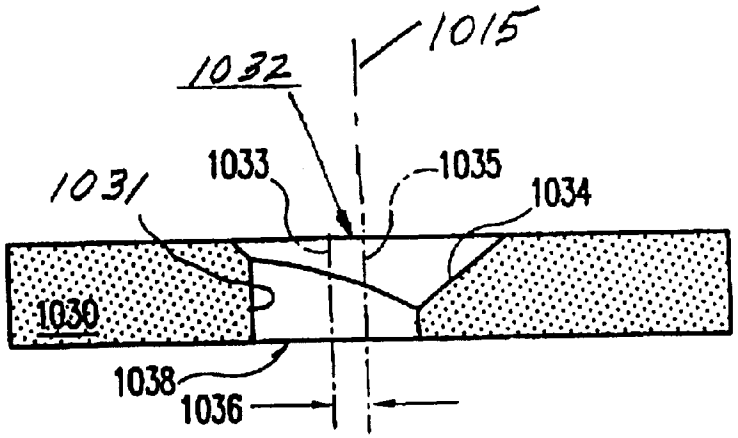
FIG. 25 is a cross-sectional view, drawn along line XXV—XXV in FIG. 24.
Figure 24:
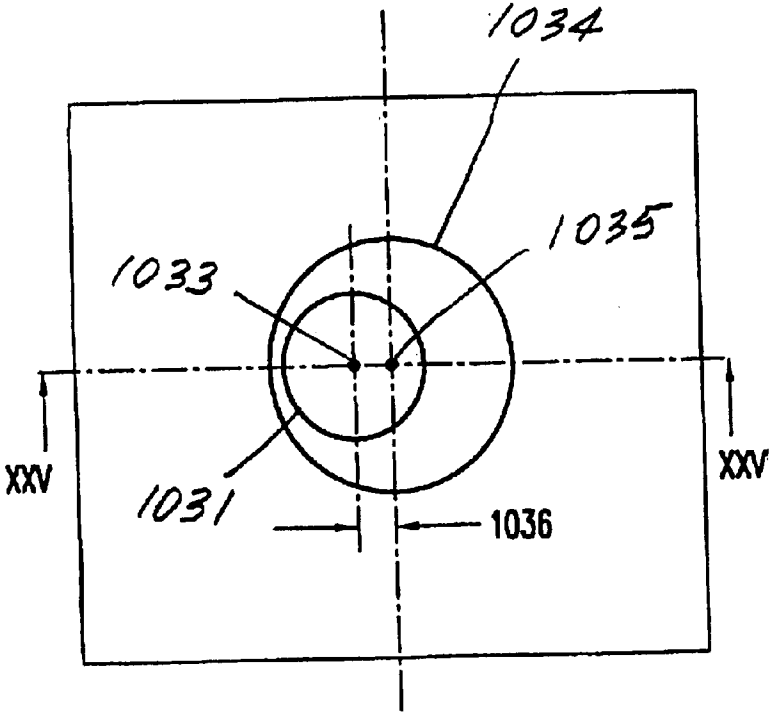
FIG. 24 is an enlarged plan view showing the top plate of the metering gate of FIG. 22.

Referring to FIGS. 24 and 25, flow channel bore 1032 in top plate 1030 includes an upper shape 1034 and a lower shape 1031. Flow channel bore 1032 is configured with two axes 1033 and 1035, which are not collinear. The two axes 1033 and 1035 are formed as the result of superpositioning of the two shapes 1031 and 1034. The two shapes 1031 and 1034 in top plate 1030 intersect and form one bore 1032 with two axes.

Shape 1034 in top plate 1030 may be a conical section (i.e. a section or frustrum of a cone). Central axis 1035 of shape 1034 is hereinafter referred to as the entry axis 1035 of flow channel 1032 in top plate 1030. Second shape 1031 in top plate 1030 may be a cylindrical section. Central axis 1033 of shape 1031 is hereinafter referred to as the outlet axis 1033 of flow channel bore 1032 in top plate 1030. Outlet axis 1033 is parallel to, but not collinear with, entry axis 1035. The distance between the two axes 1033 and 1035 is hereinafter referred to as offset 1036.

Referring to FIG. 23, entry axis 1035 of flow channel bore 1032 in top plate 1030 may be arranged so that it is collinear with main central axis 1015 of gate 1010. Outlet axis 1033 of top plate 1030, therefore, is offset from main central axis 1015 of gate 1010 in a direction of travel 1044 to open throttle plate 1040. This configuration provides a less tortuous and more symmetrical flow path when gate 1010 is partially open, as shown in FIG. 27, but still provides a relatively straight downward flow channel 1012 allowing full flow when gate 1010 is fully open, as shown in FIG. 26.

Figure 2:
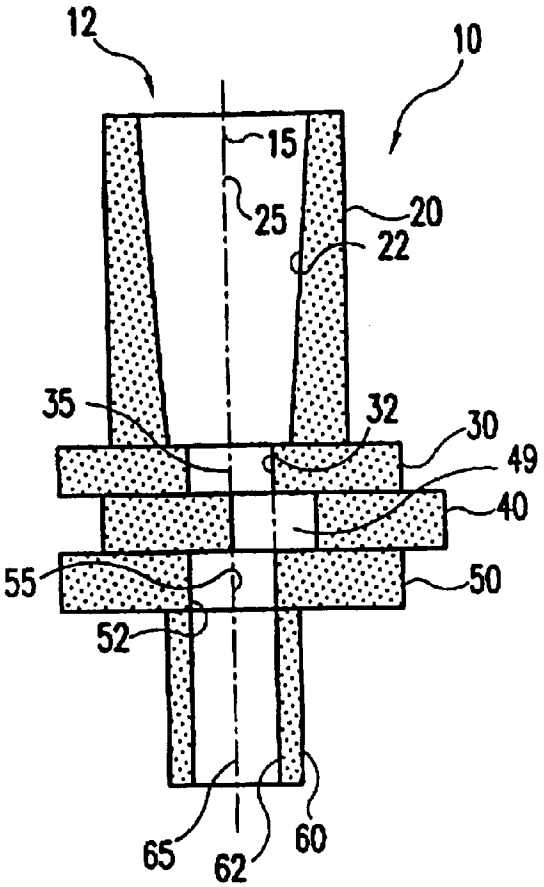
FIG. 2 is a sectional view, taken along line II—II in FIG. 1 showing the metering gate in a partially open position.
Figure 1:
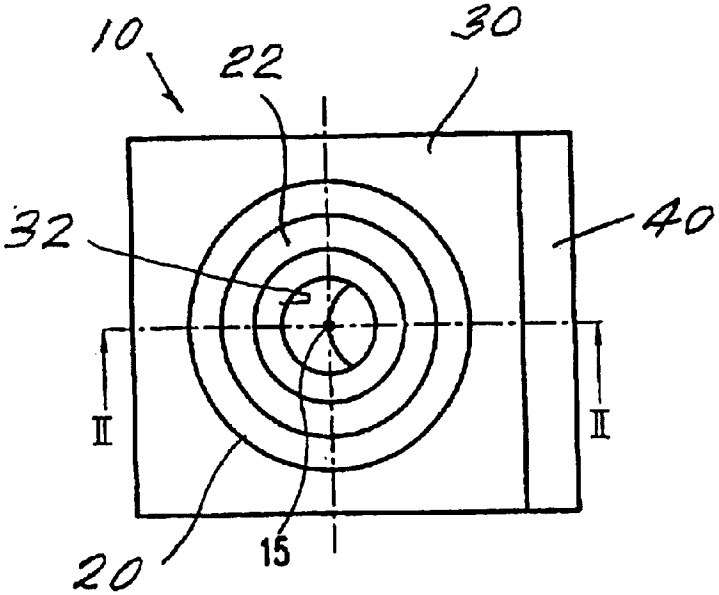
FIG. 1 is a top plan view of a known metering gate in a partially open position.
Figure 5:
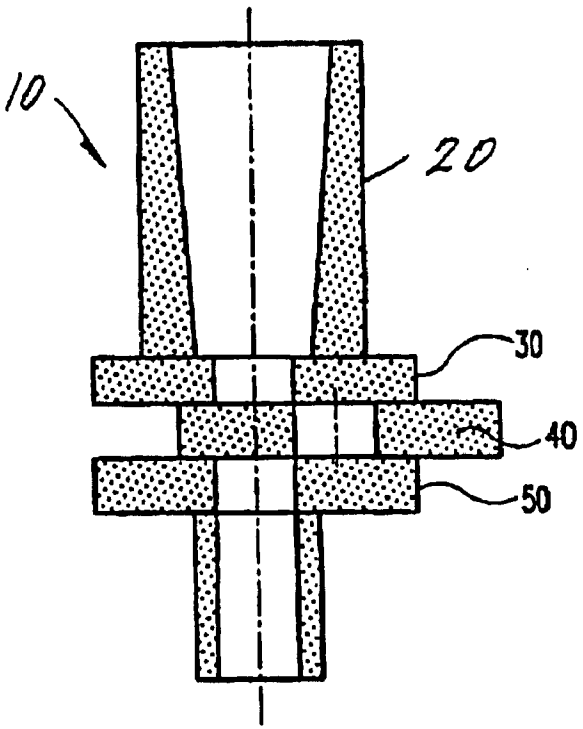
FIG. 5 is a view showing the embodiment of FIG. 2 in a gate closed position.
Figure 4:
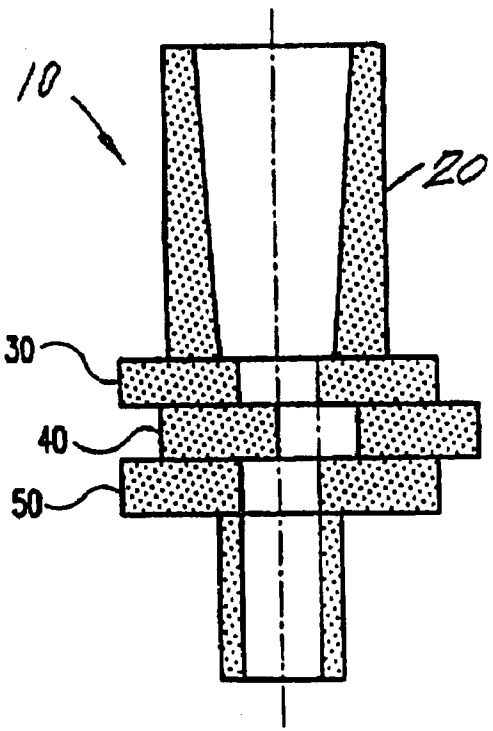
FIG. 4 is a view showing the embodiment of FIG. 2 in a partially open position.
Figure 3:
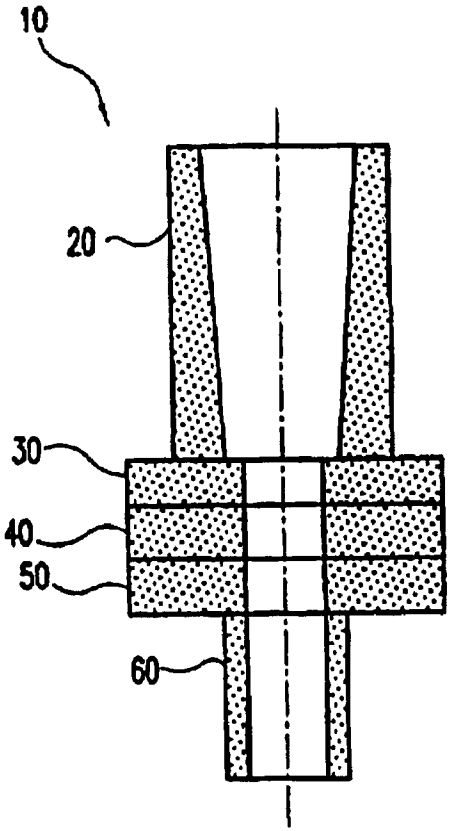
FIG. 3 is a view showing the embodiment of FIG. 2 in a fully open position.
Figure 7:
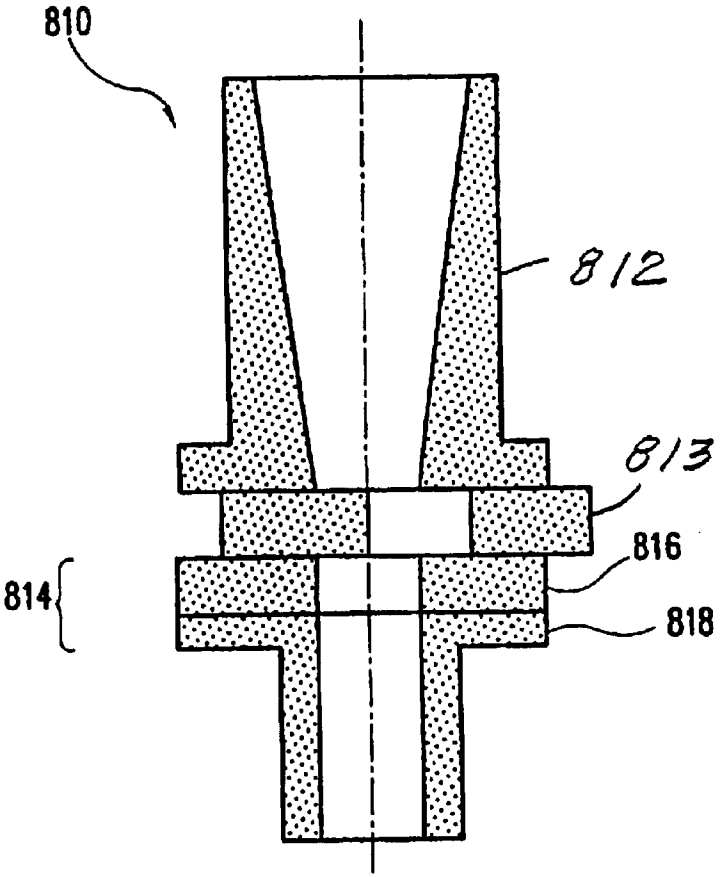
FIG. 7 is a sectional view showing a third known metering gate in a partially open position.
Figure 6:
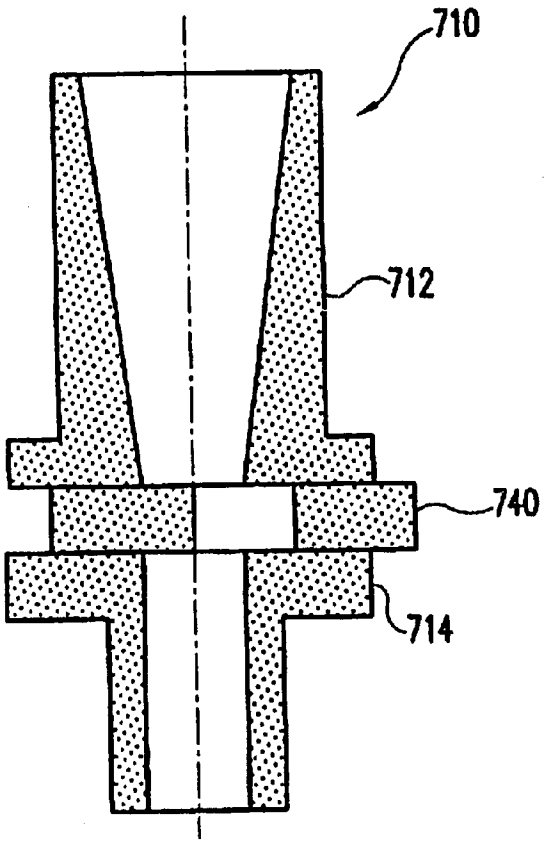
FIG. 6 is a sectional view showing a second known metering gate in a partially open position.
Figure 10:
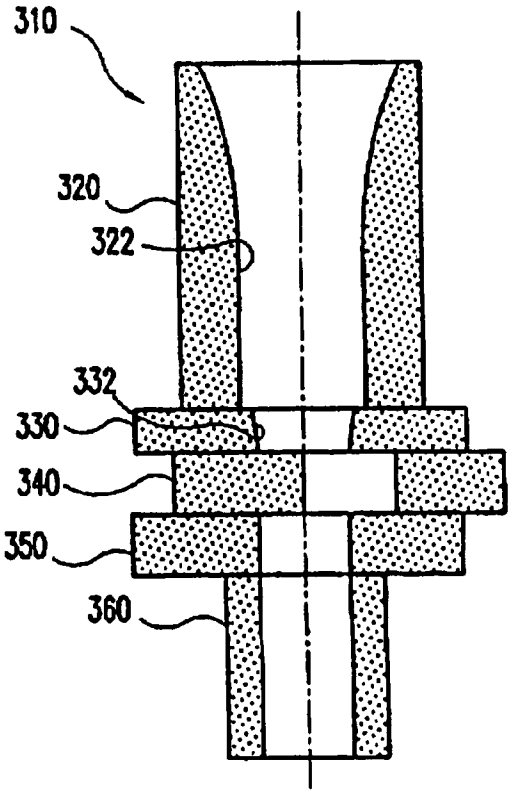
FIG. 10 is a sectional view showing a sixth known metering gate in a partially open position.
Figure 9:
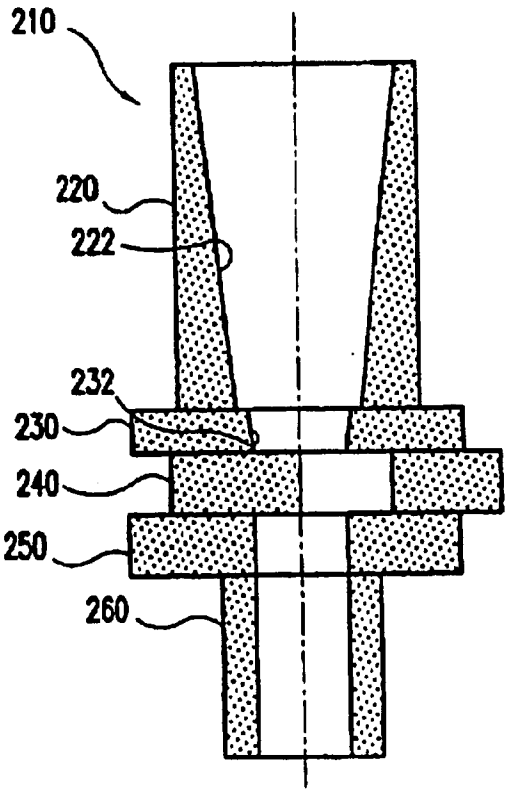
FIG. 9 is a sectional detail view showing a fifth known metering gate in a partially open position.
Figure 8:
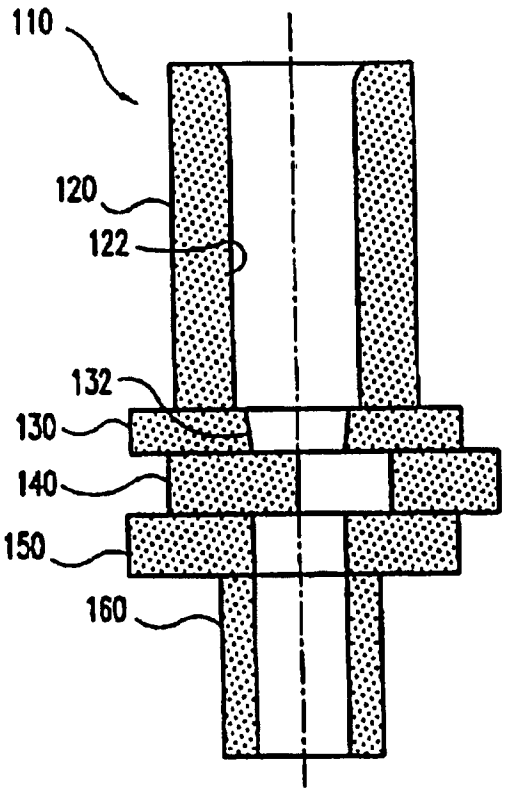
FIG. 8 is a sectional view showing a fourth known metering gate in a partially open position.
Figure 13:
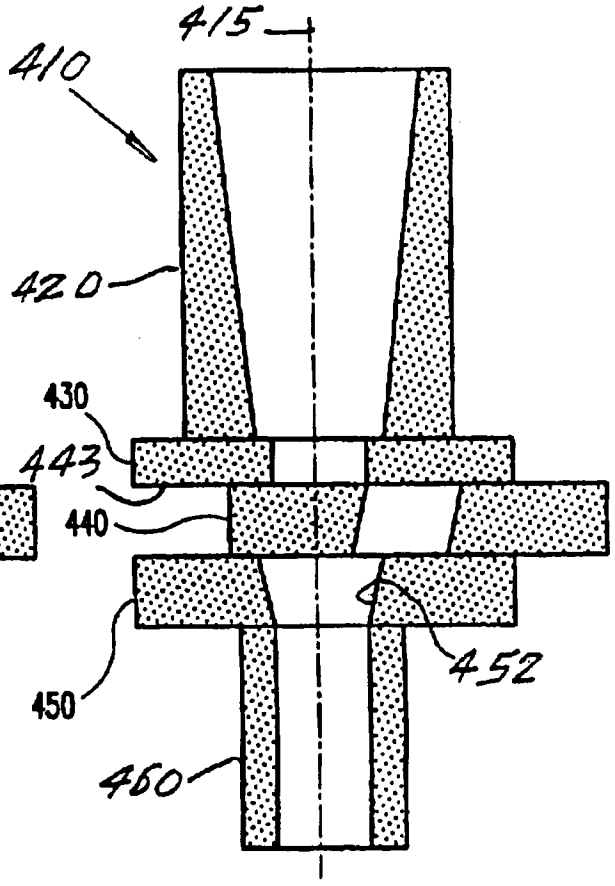
FIG. 13 is a view showing the metering gate of FIG. 11 in a gate closed position.
Figure 12:
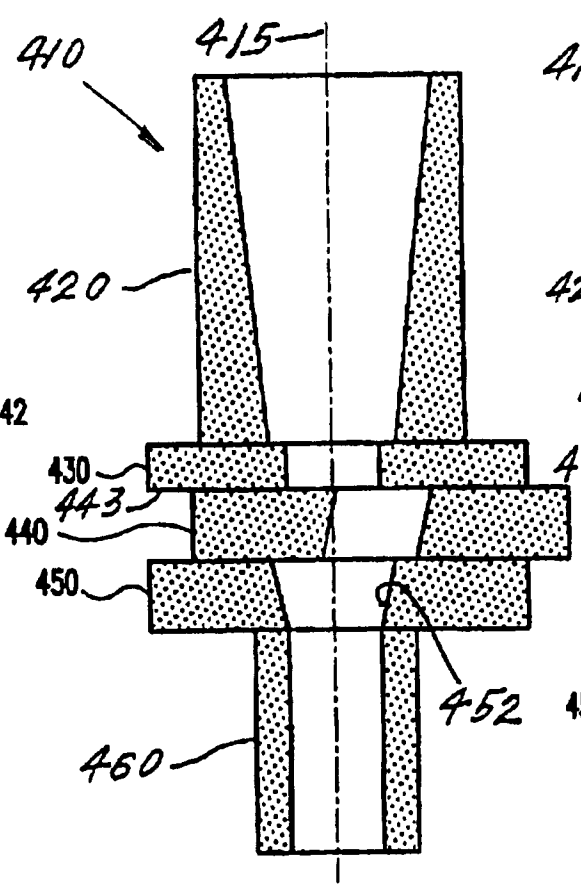
FIG. 12 is a view showing the metering gate of FIG. 11 in a partially open position.
Figure 11:
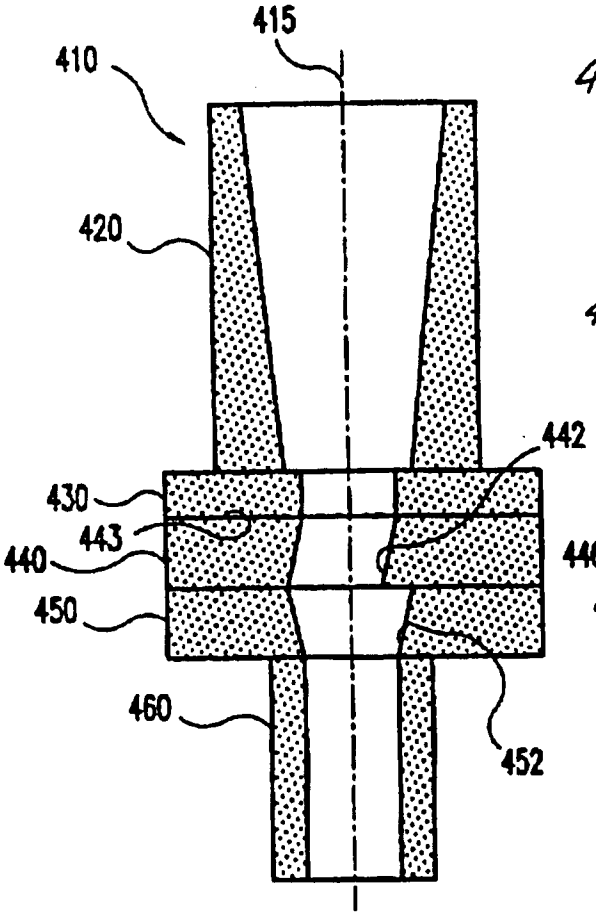
FIG. 11 is a sectional view showing a seventh known metering gate with a canted throttle plate bore, in a fully open position.
Figure 16:
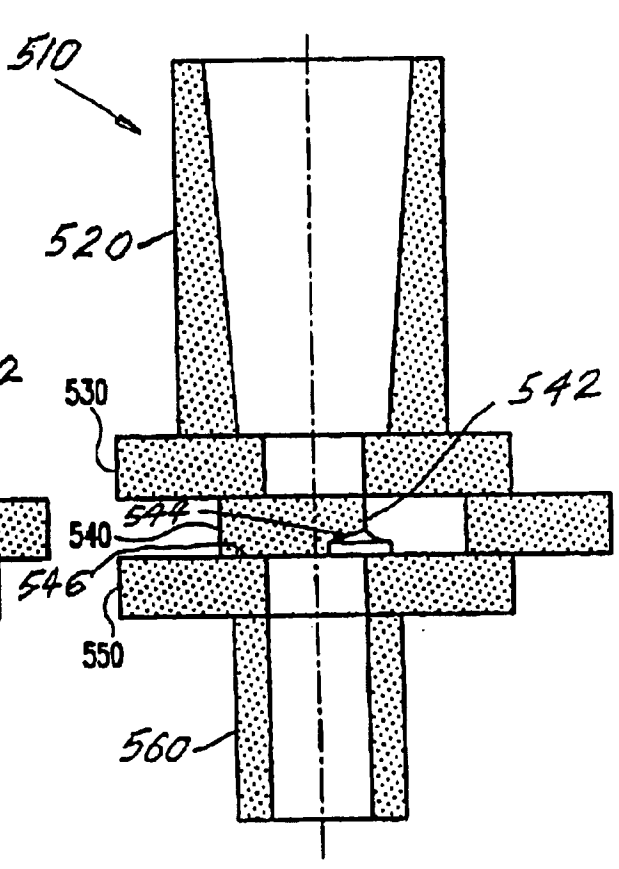
FIG. 16 is a view showing the metering gate of FIG. 14 in a gate-closed position.
Figure 15:
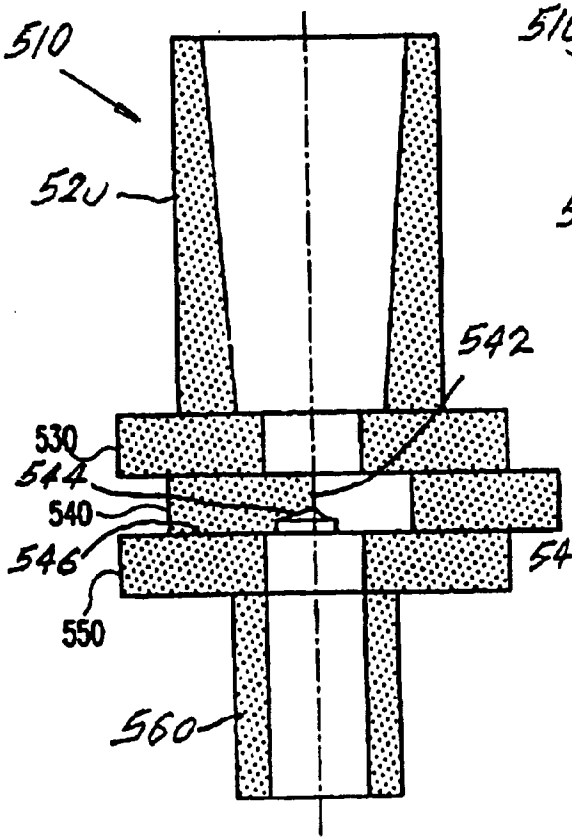
FIG. 15 is a view showing the metering gate of FIG. 14 in a partially open position.
Figure 14:
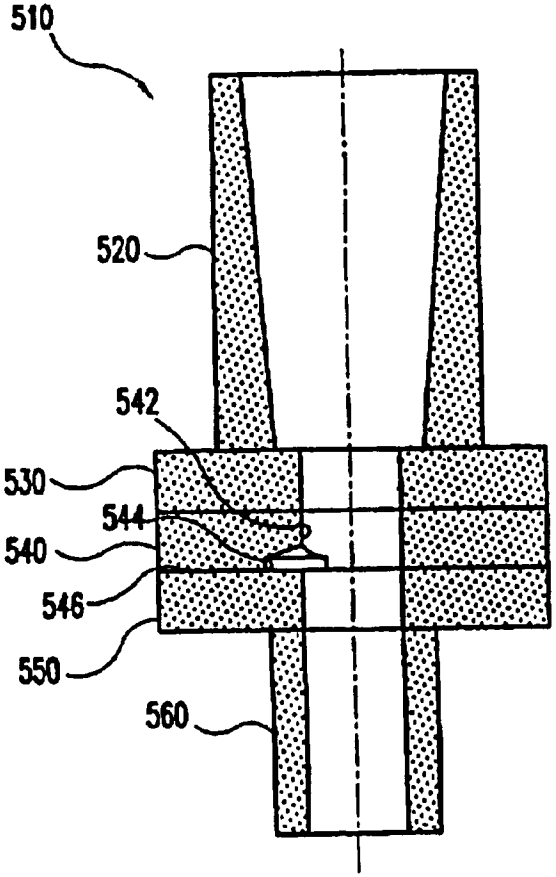
FIG. 14 is a sectional view showing an eighth known metering gate in a fully open position.
Figures 17, 18, 19:
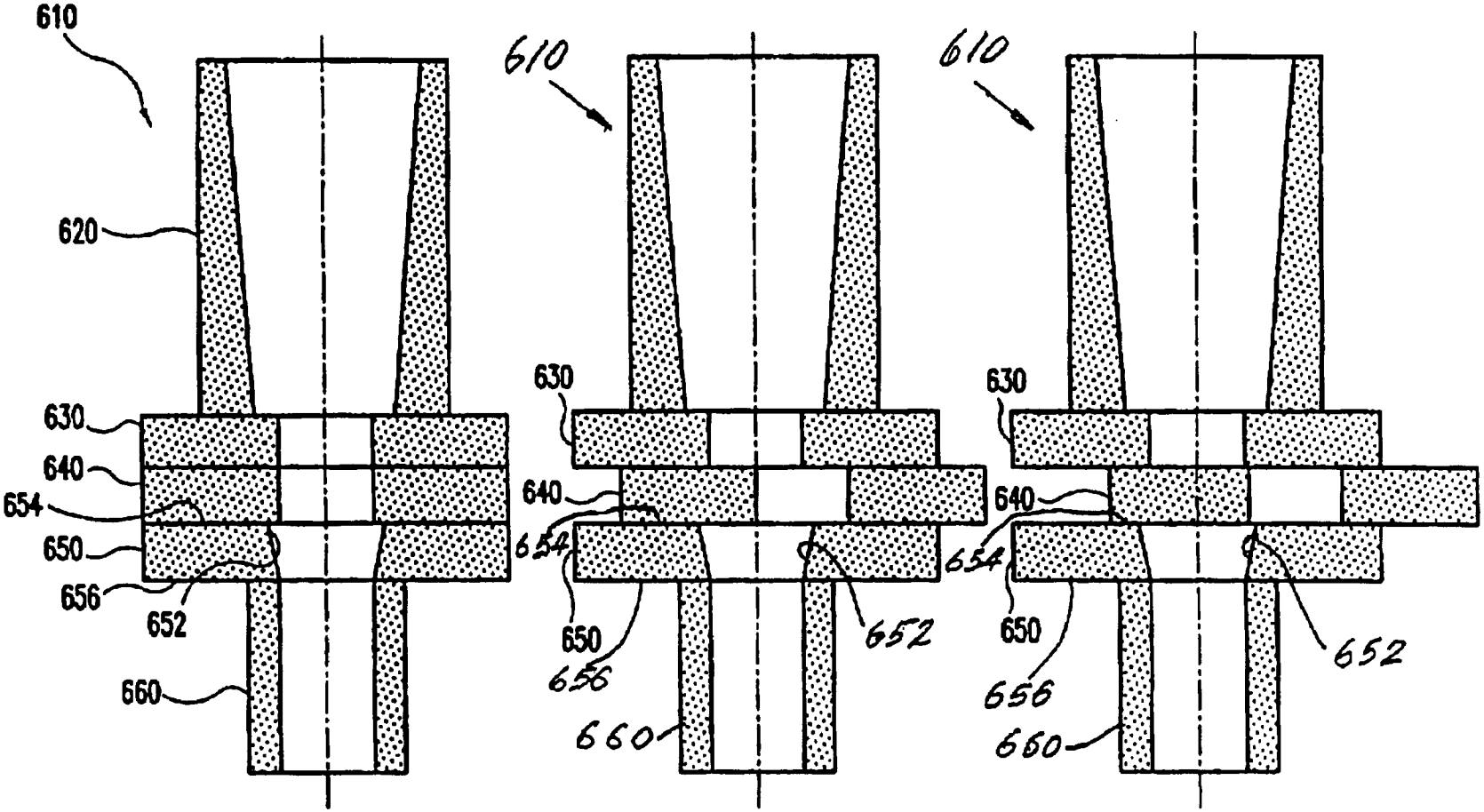
FIG. 17 is a sectional view showing a ninth known metering gate in a fully open position.
FIG. 18 is a view showing the metering gate of FIG. 17 in a partially open position.
FIG. 19 is a view showing the metering gate of FIG. 17 in a gate-closed position.
Figure 20:
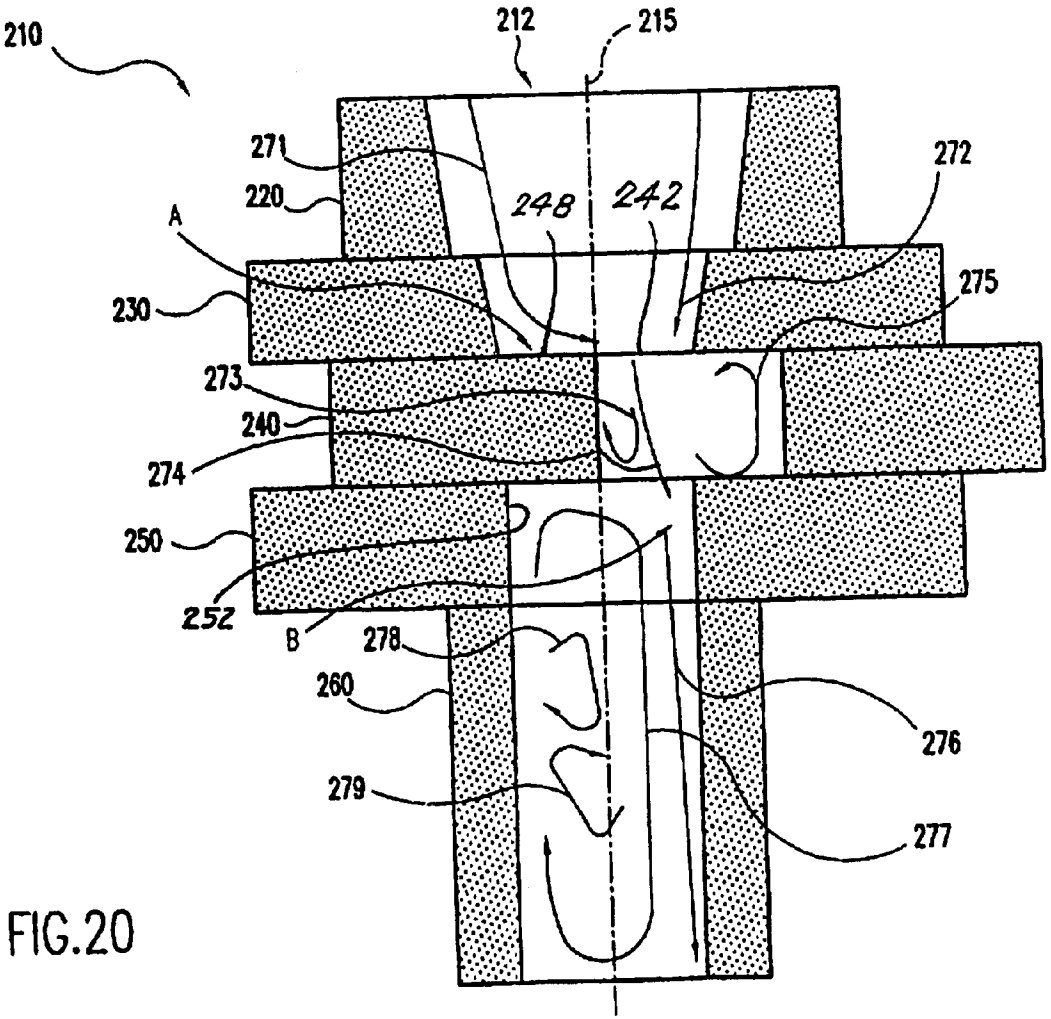
FIG. 20 is a view showing the flow patterns in the metering gate of FIG. 9.
Figure 21:
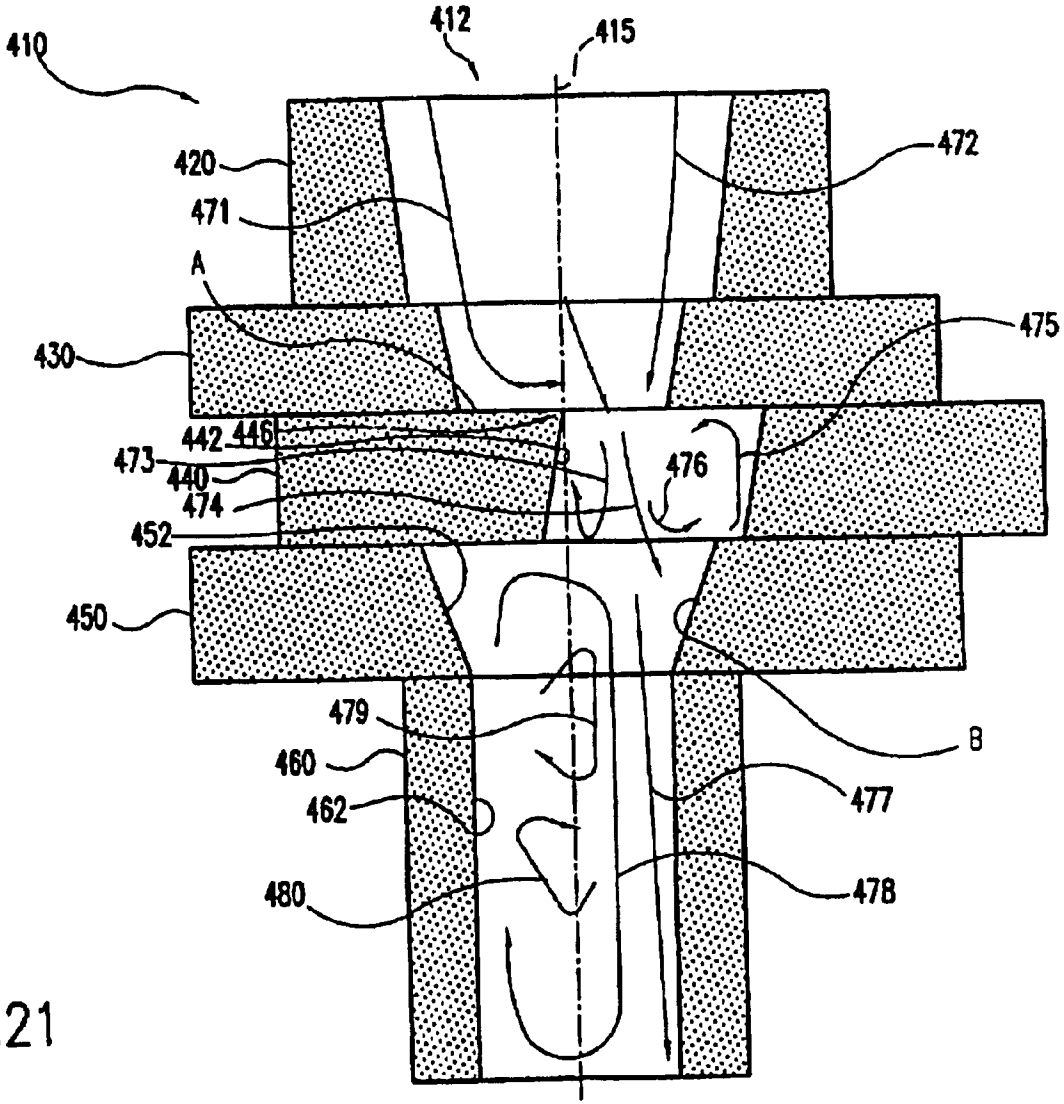
FIG. 21 is a view showing the flow patterns in the metering gate of FIG. 12.
Figure 22:
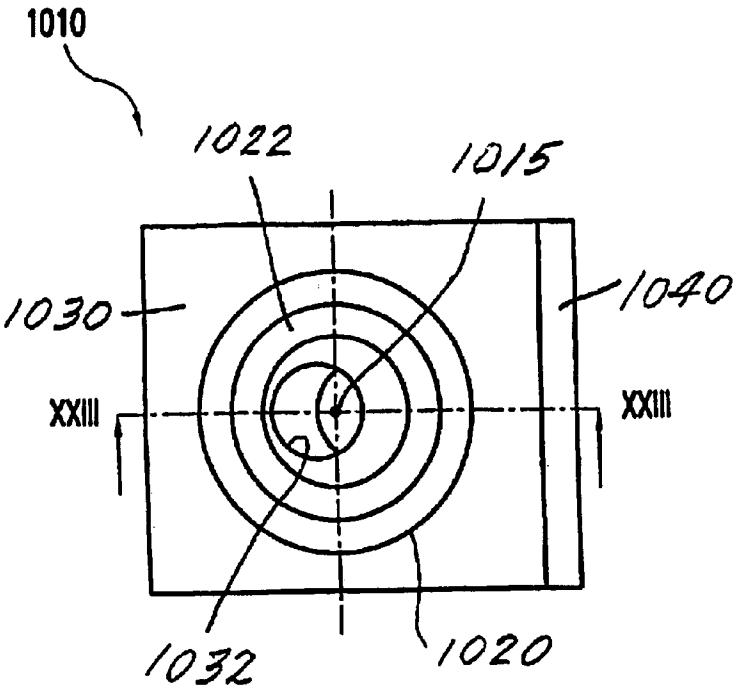
FIG. 22 is a top plan view showing an embodiment of a metering gate constructed according to the present invention in a partially open portion.

The advantages of the present invention can be better appreciated by comparing FIGS. 22 and 23 with FIGS. 1–2. As best seen by comparing FIGS. 1 and 22, rather than main central axis 15 of gate 10 occurring at or near one edge of flow channel 12, main central axis 1015 of gate 1010 is more centrally located. Indeed, prior to the present invention, it was believed that main central axis 15 of gate 10 could only lie at or near the center of flow channel 12 with gate 10 generally fully open, as shown in FIG. 3. In contrast, the present invention provides for generally central location of main central axis 1015 of gate 1010 when gate 1010 is significantly less than fully open, as shown in FIG. 23. Thus, the invention provides a straighter, less tortuous flow path for the passage of liquid metal when gate 1010 is partially open.

Referring to FIG. 25, the magnitude of offset 1036 between entry axis 1035 and outlet axis 1033 of top plate 1030 impacts the amount that present gate 1010 may be opened with a generally centered main central axis 1015. Thus, if gate 1010 typically is 65% open when operating, gate 1010 may be designed to center main central axis 1015 of gate 1010 in flow channel 1012 when metering gate is 65% open. In other words, the gate 1010 may be configured so that when the gate 1010 is 65% open, the main central axis 1015 is centered with respect to the flow channel. For example, the well nozzle 1020 may be offset relative to the exit orifice of the top plate, correspondingly offsetting the central axis 1015 relative to the flow channel.

Figures 26, 27, 28:
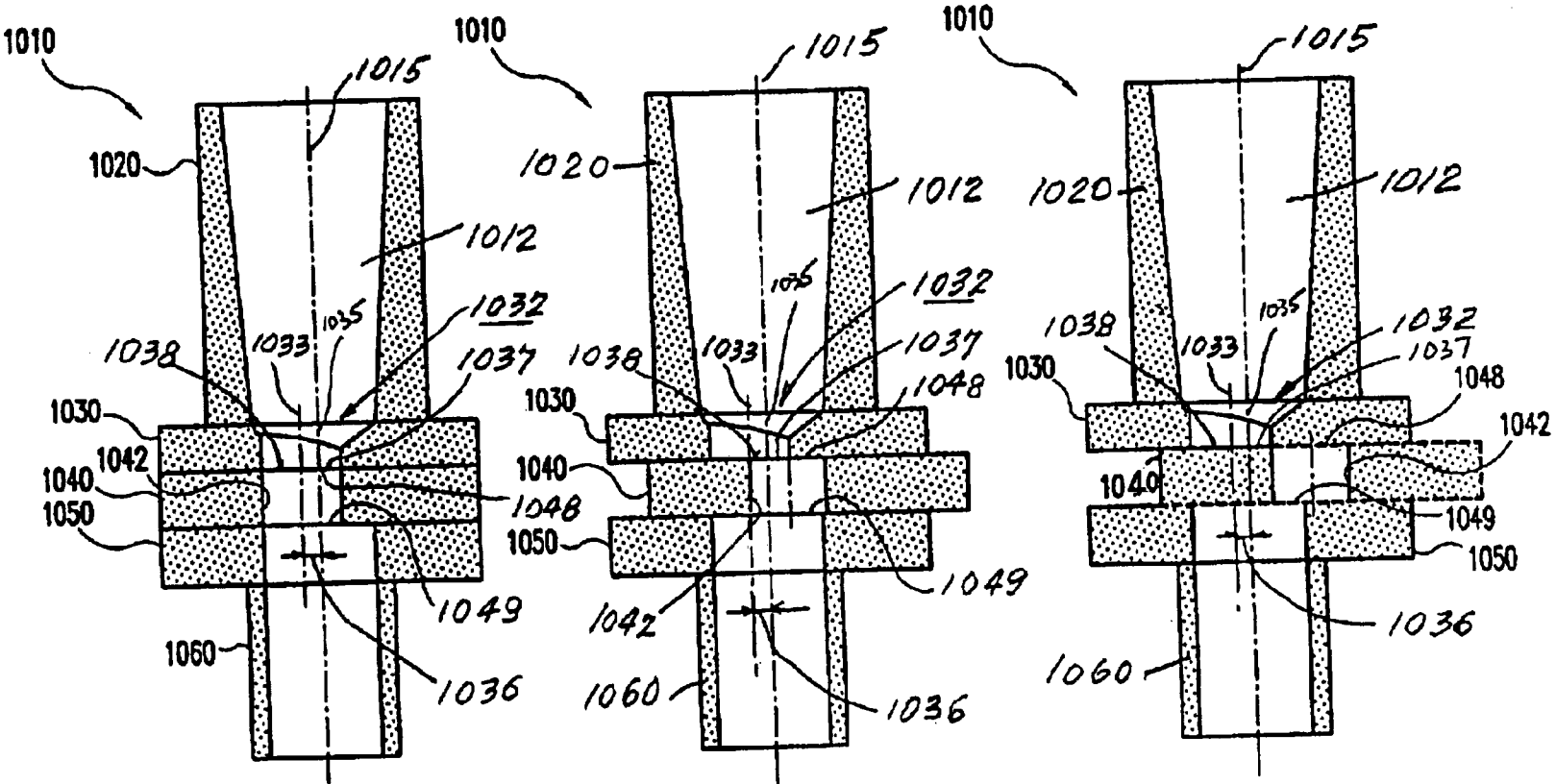
FIG. 26 is a view showing the embodiment of FIG. 23 in a fully open position.
FIG. 27 is a view showing the embodiment of FIG. 23 in a partially open position.
FIG. 28 is a view showing the embodiment of FIG. 23 in a gate-closed position.

Referring to FIGS. 26–28, the present metering gate is shown with throttle plate 1040 in different positions: a fully open gate position (FIG. 26); a partially open gate position (FIG. 27); and a closed gate position (FIG. 28). As shown in FIG. 28, in the gate closed position the invention easily allows draining of flow channel 1042 in throttle plate 1040 without special drain cuts in the bottom of throttle plate flow channel 1042 or any requirement for a conical top portion of flow channel 1052 in bottom plate 1050. This drainage feature results because the offset 1036 of outlet axis 1033 relative to the entry axis 1035 of top plate 1030 inherently moves bottom edge 1037 of flow channel bore 1032 in top plate 1030 toward main central axis 1015 of gate 1010. In other words, because exit orifice 1038 of top plate 1030 is offset relative to main central axis 1015, terminating flow through gate 1010 requires translating throttle plate 1040 only until entry orifice 1048 of throttle plate 1040 ceases to be in fluid communication with shifted top plate exit orifice 1038, which occurs before throttle plate exit orifice 1049 ceases to be in fluid communication with flow channel 1052 in bottom plate 1050. Thus, when the gate 1010 is closed, flow channel bore 1042 in throttle plate 1040 remains able to drain into flow channel 1052 in bottom plate 1050.

Figure 29:
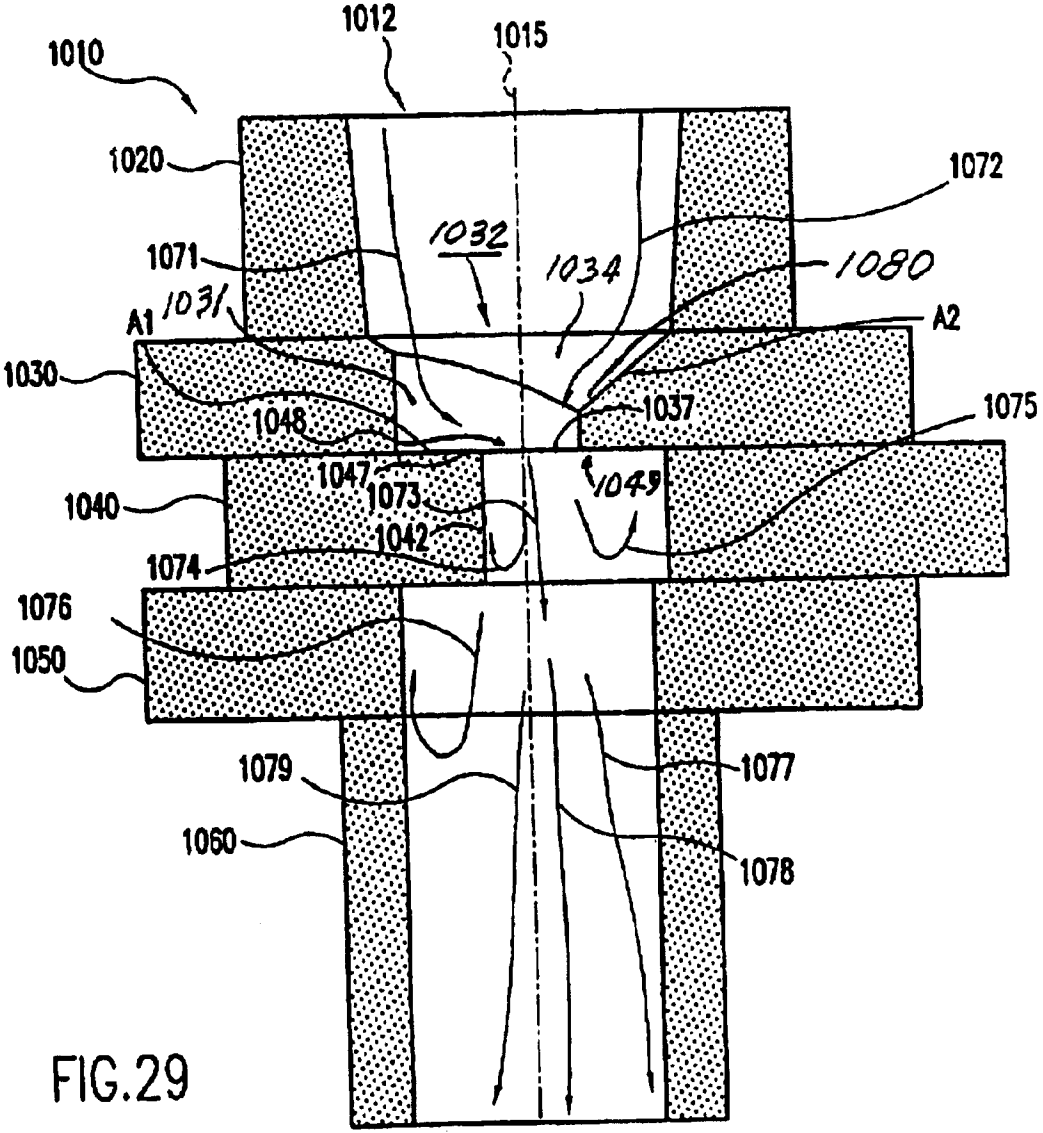
FIG. 29 is a view showing flow patterns of the metering gate of FIG. 23.
Figure 32:
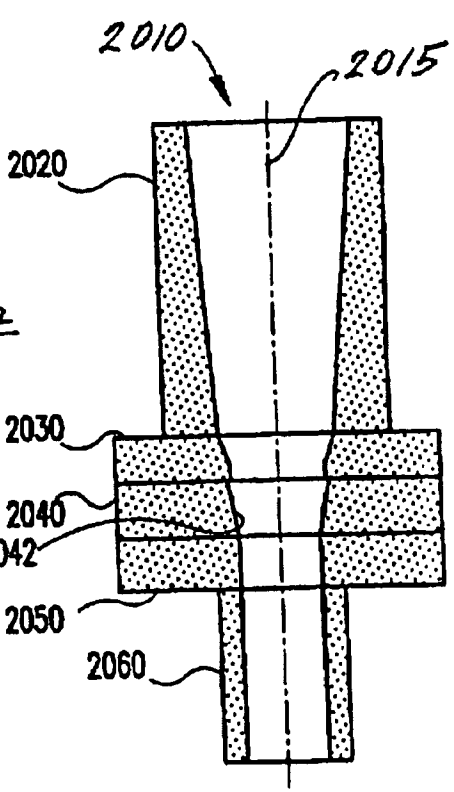
FIG. 32 is a sectional view drawn along line XXXII—XXXII in FIG. 30.
Figure 31:
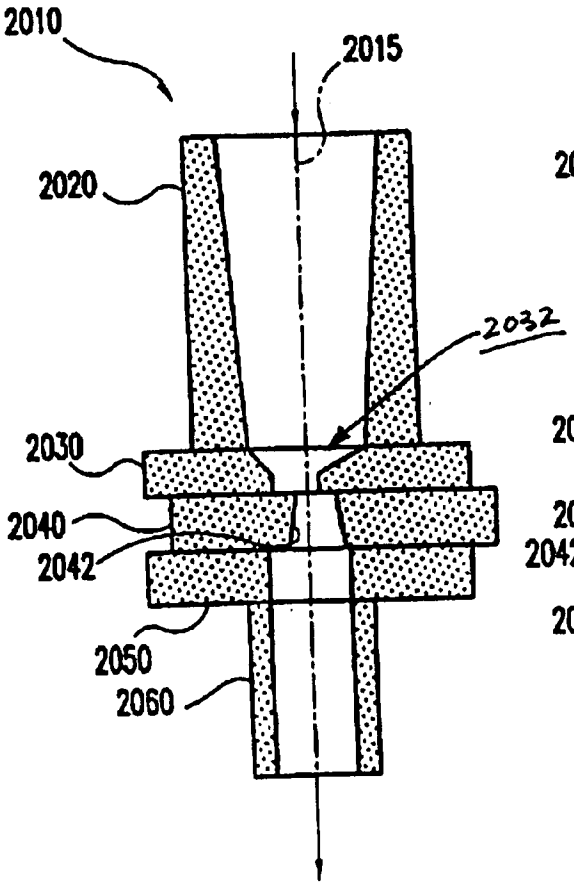
FIG. 31 is a sectional view, drawn along line XXXI—XXXI in FIG. 30.
Figure 30:
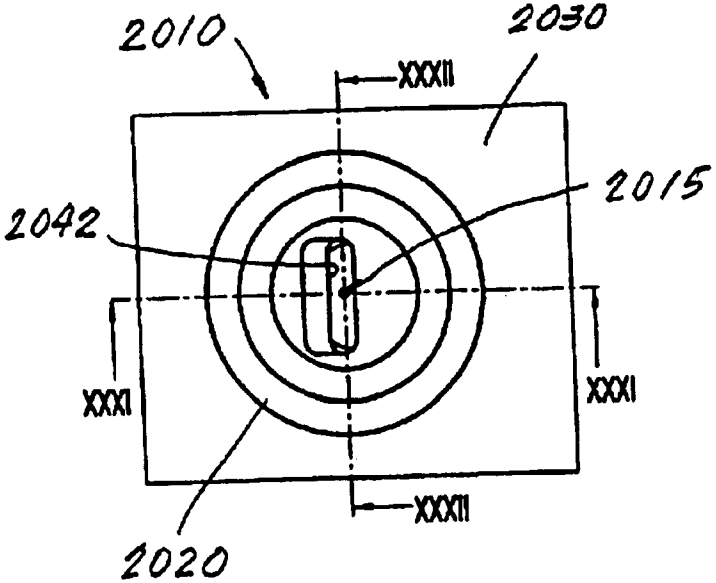
FIG. 30 is a top plan view showing another embodiment of a metering gate constructed according to the present invention in a partially open position.

The straighter and more symmetrical nature of the flow in the flow channel 1012 of metering gate 1010 of the present invention, when it is partially open, is illustrated schematically in FIG. 29. Flow 1071 impacts on upper ledge 1047 of throttle plate 1040 (Region A1) and bends toward opening 1048 of throttle plate 1040. Flow 1072, a second portion of the flow, also is bent, but in the opposite direction from flow 1071, towards opening 1048 as it impacts on entry port 1080 of shape 1034 of top plate 1030 (Region A2). Thus, the invention promotes two-sided bending of the flow entering opening 1048 with the bending on each side being towards main central axis 1015 of gate 1010. For this reason, high velocity jet flow 1073 formed in throttle plate bore 1042 is not strongly tilted away from main central axis 1015. High velocity jet flow 1073 is nearly collinear with main central axis 1015 of gate 1010, thereby achieving a greater degree of flow symmetry.

Jet flow 1073 does not impinge strongly upon one side of bore 1052 in bottom plate 1050, therefore portions of recirculating flows 1074, 1075, and 1076 are weaker and less extensive as compared to corresponding flows in gates not constructed according to the invention. The flow pattern in bottom plate 1050 and outlet tube 1060 is more symmetrical and spreads more evenly with downward flows 1077, 1078, and 1079 occupying a greater portion of flow channel 1052 and 1062 in bottom plate 1050 and outlet tube 1060.

Figure 37:
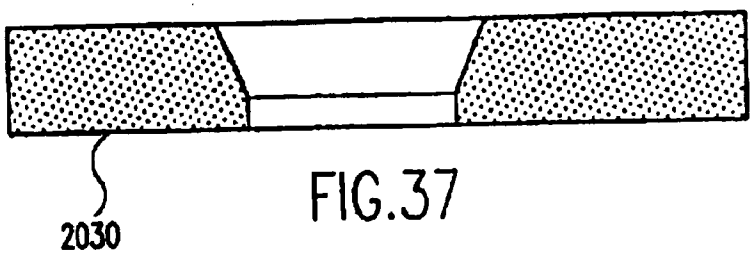
FIG. 37 is a sectional view drawn along line XXXVII—XXXVII in FIG. 36.
Figure 38:
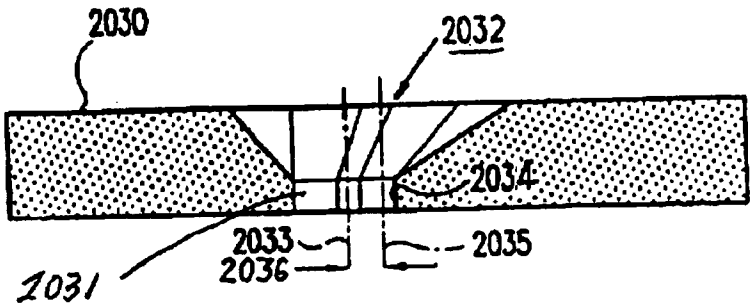
FIG. 38 is a sectional view, drawn along line XXVIII—XXVIII in FIG. 36.
Figure 36:
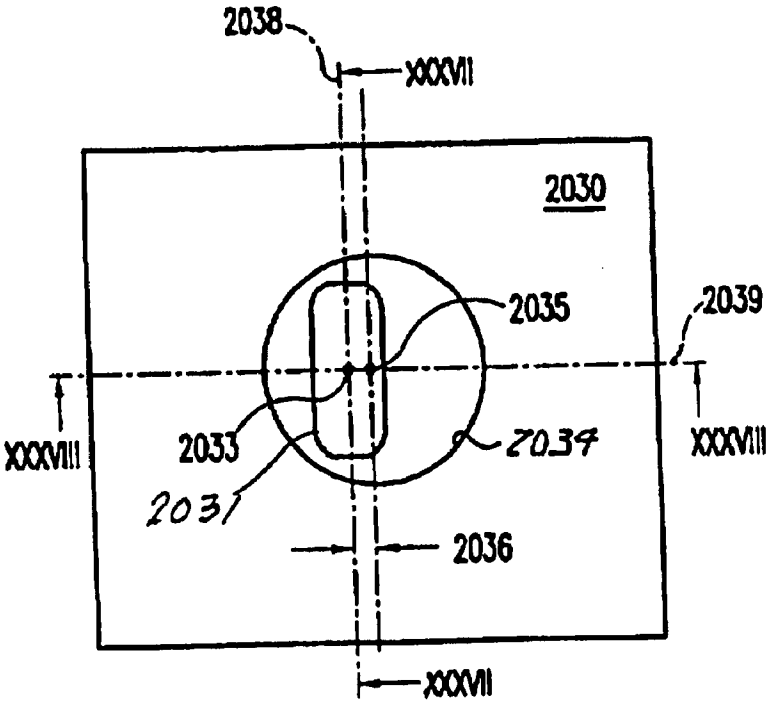
FIG. 36 is an enlarged top plan view showing the top plate of the metering gate of FIGS. 30–33.
Figure 40:
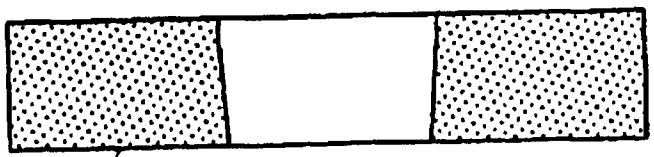
FIG. 40 is a sectional view drawn along line XL—XL in FIG. 39.
Figure 41:
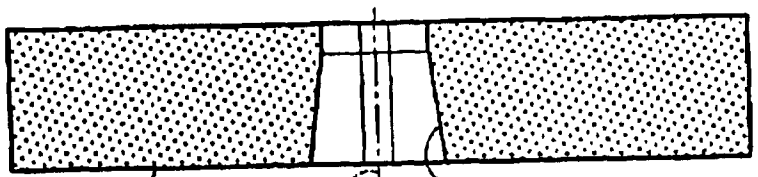
FIG. 41 is a sectional view drawn along line XLI—XLI in FIG. 39.
Figure 39:
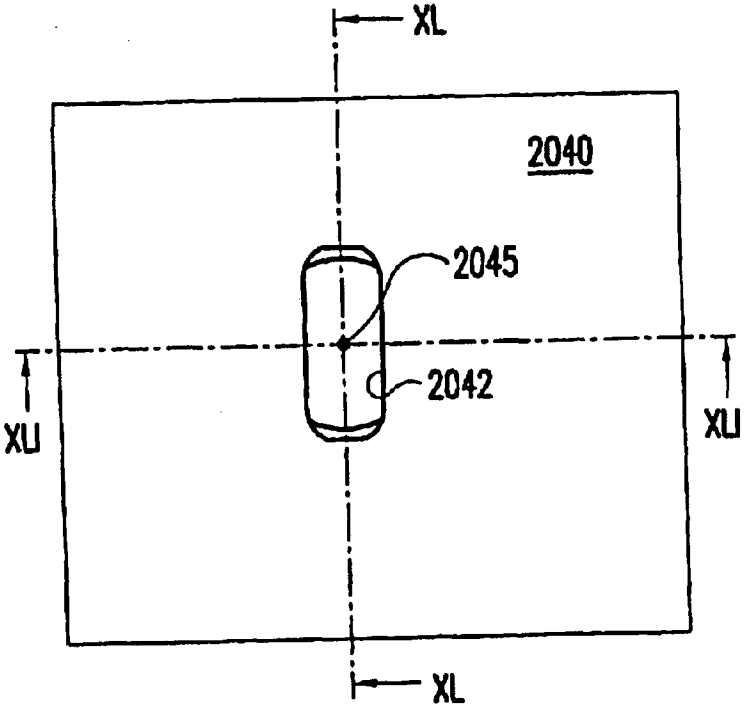
FIG. 39 is an enlarged plan view showing the throttle plate of the metering gate of FIGS. 30–33.
Figure 43:
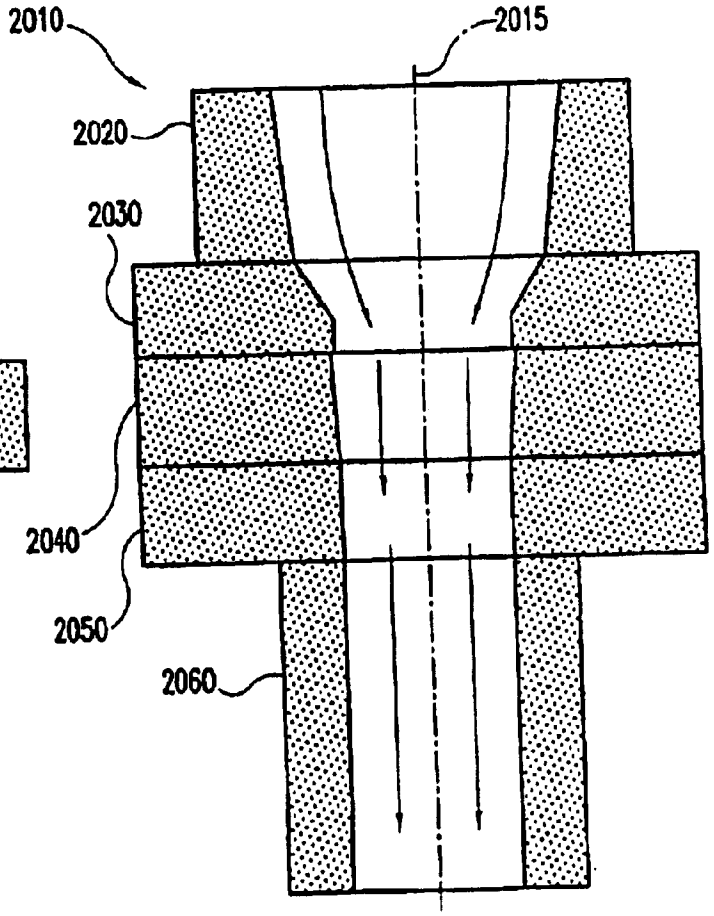
FIG. 43 is a view showing flow patterns in the metering gate of FIG. 32.
Figure 42:
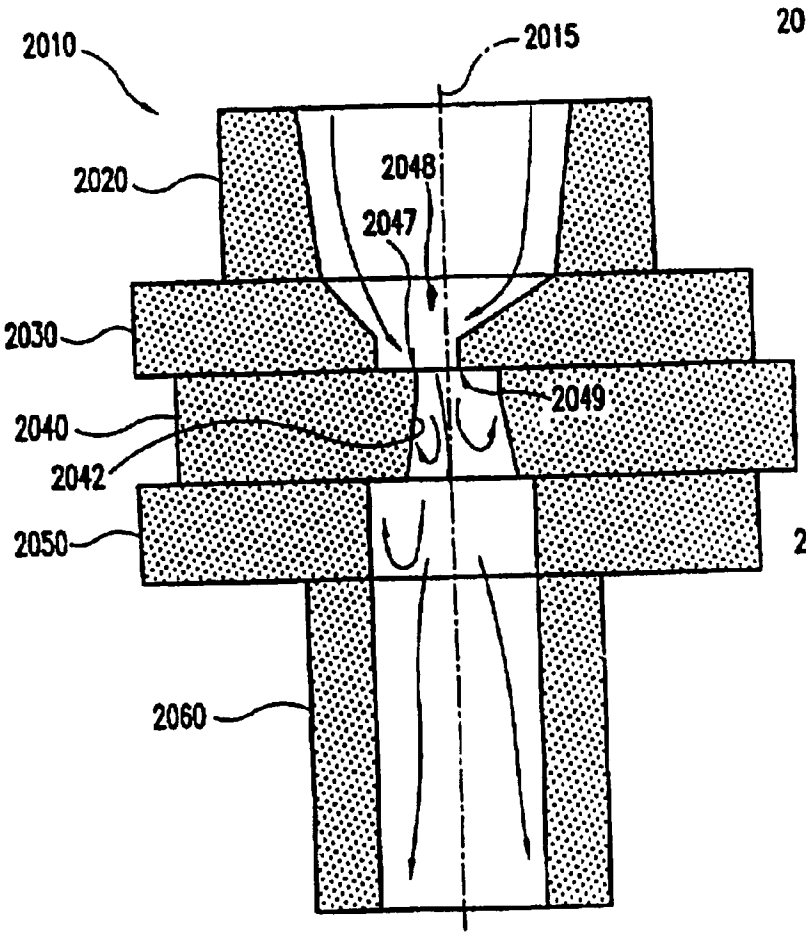
FIG. 42 is a view showing flow patterns in the metering gate of FIG. 31.

FIGS. 30–35 show a second embodiment of a metering gate 2010 constructed according to the invention, and the flow pattern promoted therein is illustrated in FIGS. 42 and 43. FIGS. 36–38 show enlarged views of top plate of 2030 thereof. FIGS. 39–41 show enlarged views of the throttle plate 2040 thereof. Throttle plate 2040 has a flow channel bore 2042 with a cross-section defined by an elongated lofted bore. "Lofting" is a term well known by one of reasonable skill in the art of computer-aided design of three-dimensional solids, and is one way to connect two closed figures, such as a circle, oval or polygon, that exist on different planes. As used in this application, "loft" implies no twist.

Figures 33, 34, 35:
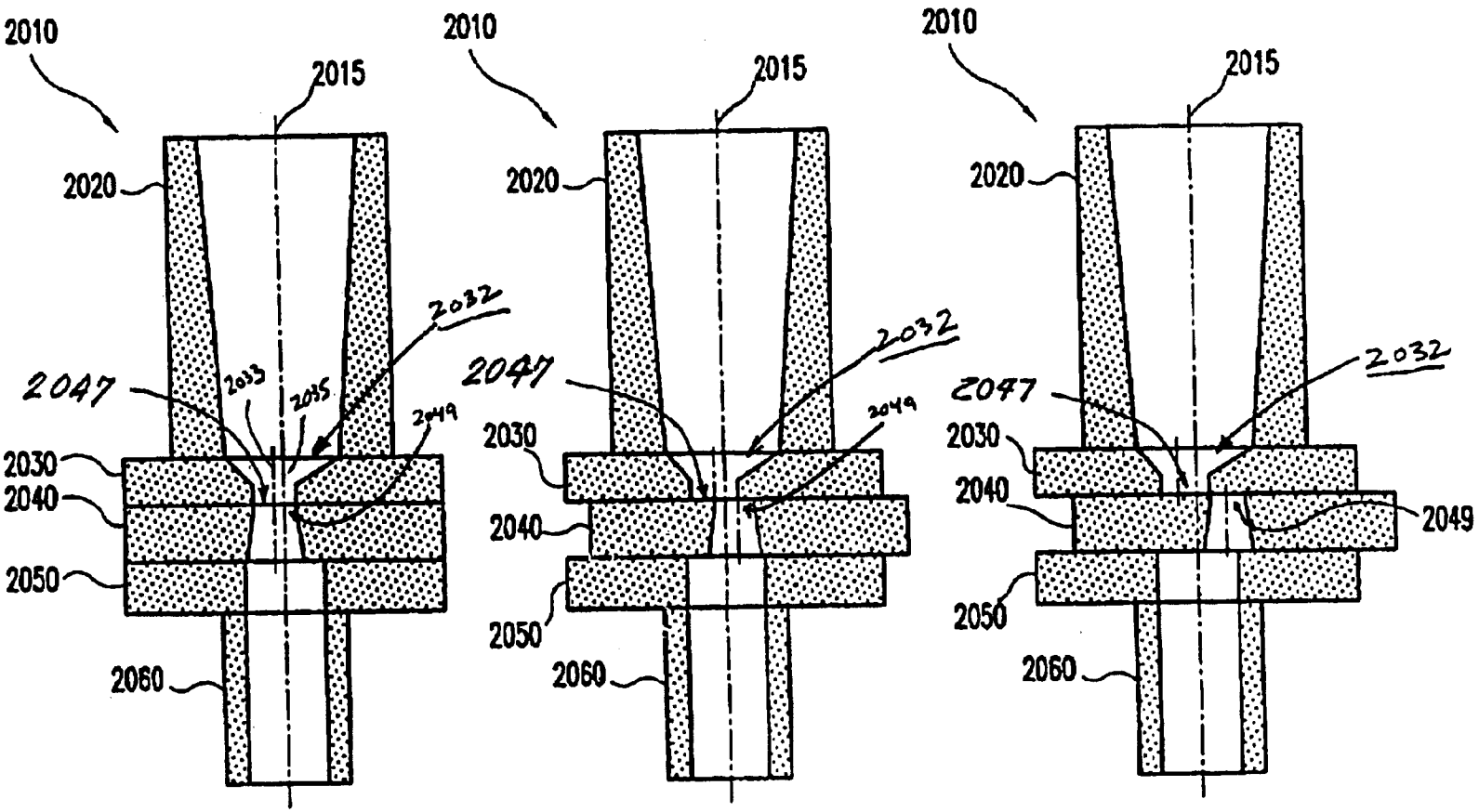
FIG. 33 is a view showing the embodiment of FIG. 31 in a fully open position.
FIG. 34 is a view showing the embodiment of FIG. 31 in a partially open position.
FIG. 35 is a view showing the embodiment of FIG. 31 in a gate-closed position.

Metering gate 2010 incorporates two important features: (1) as shown in FIGS. 36 and 38, an offset 2036 between one axis 2033 of flow channel bore 2032 in top plate 2030 and main central axis 2015 of gate 2010, as described previously with respect to metering gate 1010; and (2) flow channel bores 2032, 2034 (FIG. 36) and 2042 (FIG. 30) of unique geometry in top plate 2030 and throttle plate 2040, respectively, which are narrower in the direction in which throttle plate 2040 moves and elongated in a direction orthogonal thereto. Thus, flow channel bore 2032 formed about exit axis 2033 of top plate 2030 and flow channel 2042 of throttle plate 2040 are not axisymmetrical, but planar symmetrical, that is, symmetrical with respect to plane 2039. FIGS. 33–35 show metering gate 2010 in a fully open position (FIG. 33), a partially open position (FIG. 34) and a closed gate position (FIG. 35).

Referring to FIGS. 36–38, flow channel bore 2032 in top plate 2030 is designed with two non-collinear axis 2033 and 2035 lying in a plane 2036. Axis 2035 is collinear with main central axis 2015. The two axis 2033 and 2035 of flow channel 2032 of top plate 2030 are formed as the result of the superpositioning of two shapes 2031 and 2034. The two shapes 2031 and 2034 in top plate 2030 intersect, forming one bore 2032 with two axis. First shape 2034 in top plate 2030 may be a lofted bore which has a circular cross-section at the top of plate 2030 that smoothly transitions into an elongated cross-section below the top of top plate 2030. Central axis 2035 of the circular cross-section is the entry axis. Second shape 2031 in top plate 2030 is elongated in a direction orthogonal to plane 2039, i.e. parallel to plane 2038. Central axis 2033 of this second shape 2031 is the exit axis. Exit axis 2033 is parallel, but not collinear, with entry axis 2035. The two axis 2033 and 2035 define a distance or offset 2036.

The planar-symmetrical configuration of the top plate and the throttle plate flow channels reduces the lateral dimension of the opening in the direction of throttle plate movement because the highest degree of asymmetry in the flow occurs in this direction. The planar-symmetrical configuration increases the dimension of the opening in the orthogonal direction because asymmetry is not introduced into the flow in the orthogonal direction. Thus, the present configuration provides additional straightening of the jet flow formed in flow channel 2042 of throttle plate 2040 and further improves the symmetry of the flow in bottom plate 2050 and outlet tube 2060 when gate 2010 is partially open. This is because, when partially open, the configuration reduces the proportion of the flow that is bent and provides a more symmetrical bending of this portion of the flow when it approaches opening 2048 of throttle plate 2040. Also, this configuration minimizes the extent of shelf 2047 above throttle plate 2040 and under-shelf region 2049 of flow channel 2042 in throttle plate 2040, shown in FIG. 35, as compared with shelf 1047 and under-shelf region 1049, shown in FIG. 29, which are critical areas for reducing clogging.

FIGS. 39–41 show the throttle plate 2040 of the second embodiment of the invention. The throttle plate 2040 has a flow channel 2042 with a cross-section defined by an elongated lofted bore.

FIGS. 42 and 43 schematically represent the flow pattern developed in the second embodiment of gate 2010 when partially open. The flow behavior shown in FIG. 42 is very similar to that in FIG. 29 except that the bending of the flow therethrough generally is more symmetrical. The flow behavior shown in FIG. 43 is symmetrical and uniform with little bending. As a result of the elongated configuration of flow channels 1032 and 1042 in top plate 1030 and throttle plate 1040, respectively, a higher proportion of flow passes through gate 2010 with little bending. Thus, the flow path is generally straight and there is no over-restriction of the flow with a generally more symmetrical flow readily developed in outlet tube 2060.

Figure 46:
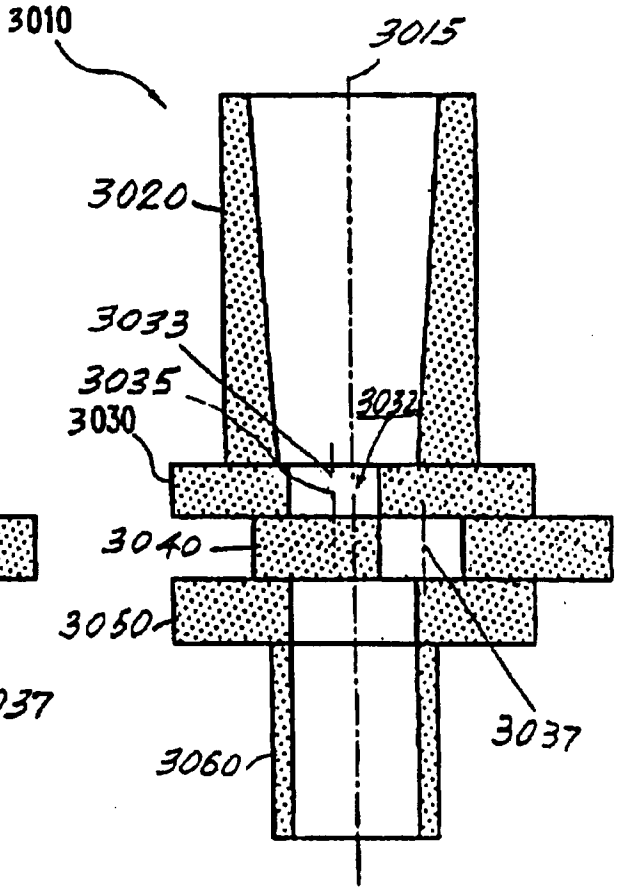
FIG. 46 is a view showing the embodiment of FIG. 44 in a closed position.
Figure 45:
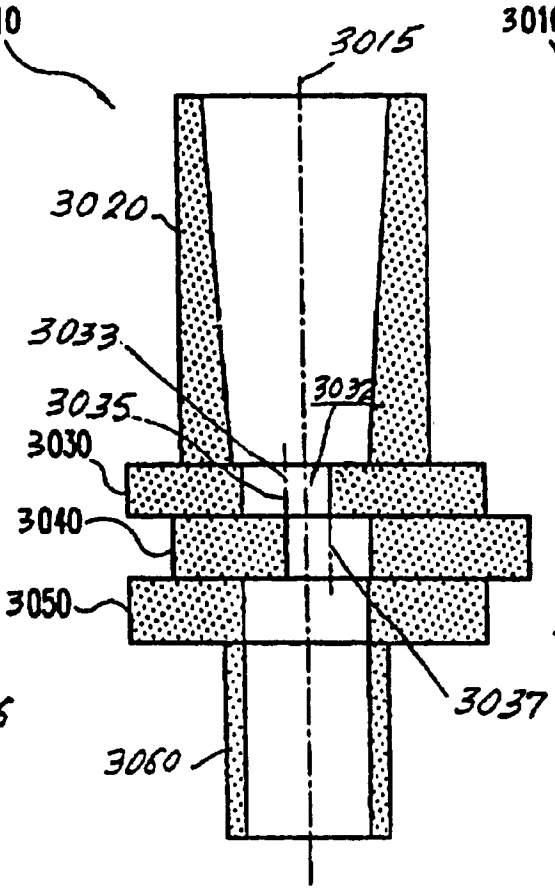
FIG. 45 is a view showing the embodiment of FIG. 44 in a partially open position.
Figure 44:
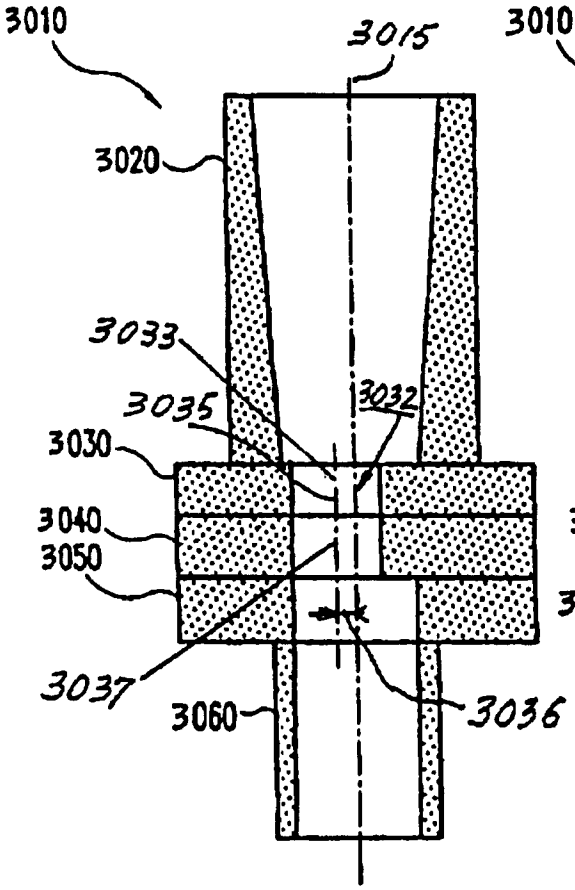
FIG. 44 is a sectional view showing another embodiment of a metering gate constructed according to the present invention in a fully open position.

FIGS. 44–46 show a third embodiment of a metering gate 3010 constructed according to the invention. FIGS. 44–46 show metering gate 3010 in a fully open position (FIG. 44), a partially open position (FIG. 45) and a closed gate position (FIG. 46).

Referring to FIGS. 44–46, metering gate 3010 has a main central axis 3015, and flow channel bore 3032 in top plate 3030 is designed with two collinear axis 3033 and 3035. Axis 3033 is the entry axis of top plate 3030 and axis 3035 is the exit axis of top plate 3030. Throttle plate 3040 has a central axis 3037. Bore 3032 in top plate 3030 is a simple straight-through bore.

Axes 3033 and 3035 are parallel to but offset from main central axis 3015. Axes 3033 and 3035 are offset a distance 3036 from main central axis 3015.

Overall, the invention results in less flow restriction and a reduction in the rate and extent of clogging as compared with other metering gates. The recirculating flows are less extensive and weaker, which inhibits the build-up of metallic or non-metallic clogging material in critical regions of the flow channel, such as the hole or bore of the throttle plate. The improved symmetry of the flow in the outlet tube improves the uniformity of discharge of liquid metal from the outlet tube with a beneficial effect on mold flow behavior and on cast metal quality. Also, impingement of the flow on the sides of the flow channel is less severe and the potential for accelerated refractory erosion is reduced.

Although the present invention has been described in relation to particular embodiments thereof, many other variations and modifications and other uses will become apparent to those skilled in the art. It is preferred, therefore, that the present invention be limited not by the specific disclosure herein.

We claim:

1. An apparatus for metering flow in the continuous casting of molten metal including a metering gate, in which the metering gate comprises:

a top plate having a first flow channel bore with an inlet having an inlet axis and an outlet having an outlet axis where the inlet axis and the outlet axis are offset; and a throttle plate slidably contacting the top plate and adapted for selectably receiving flow from the top plate.

2. The apparatus of claim 1, wherein the first flow channel bore is defined by superpositioning a plurality of shapes.

3. The apparatus of claim 2, wherein the plurality of shapes are symmetrical and have respective axes of symmetry.

4. The apparatus of claim 2, wherein the plurality of shapes are selected from a group consisting of cylindrical shapes, conical shapes and combinations thereof.

5. The apparatus claim 2, wherein the offset occurs in an offset direction; and at least one of the plurality of shapes is narrower along the offset direction.

6. The apparatus of claim 2, wherein the plurality of shapes define an entry port for deflecting flow therethrough.

7. The apparatus of claim 6, wherein the throttle plate includes a second flow channel bore, the throttle plate being translatable relative to the top plate along a translation direction generally orthogonal to a fluid flowable from the outlet of the first flow channel bore.

8. The apparatus of claim 7, wherein the throttle plate defines a ledge which deflects flow leaving the first flow channel bore, and the entry port and the ledge are adapted to cooperatively bend flow into the second flow channel bore.

9. The apparatus of claim 7, wherein the second flow channel bore is configured to expand fluid.

10. The apparatus of claim 7, wherein the second flow channel bore is an elongated, lofted bore.

11. The apparatus of claim 7, wherein the second flow channel bore is constricted along the translation direction.

12. The apparatus of claim 7, wherein the offset occurs along the translation direction.

13. The apparatus of claim 7, wherein the metering gate further comprises a bottom plate having a third flow channel bore arranged relative to the throttle plate such that the third flow channel bore is in fluid communication with the second flow channel bore regardless of translation of the throttle plate.

14. The apparatus of claim 13, wherein the third flow channel bore includes a third axis that is collinear with the inlet axis.

15. The apparatus of claim 7, wherein:

the second flow channel bore has a second axis; and when the throttle plate is in an open position, the second axis is collinear with the outlet axis.

16. A method for metering flow in the continuous casting of molten metal comprising:

passing fluid into a first flow channel bore in a stationary first plate of a metering gate in a first vertical direction; and passing fluid out of the first flow channel bore in the first plate in a second vertical direction horizontally offset from the first vertical direction.

17. The method of claim 16, further comprising moving a second plate along a translation direction, the second plate having a second flow channel bore, relative to the first plate between an open position, for passing fluid into the second flow channel bore from the first passage, and a closed position, for prohibiting the passing of fluid into the second flow channel bore from the first flow channel bore.

18. The method of claim 17, further comprising passing fluid out of the first flow channel bore by constricting the first flow channel bore along the translation direction of the moving second plate.

19. The method of claim 17, further comprising expanding the fluid in the second flow channel bore.

20. The method of claim 17, further comprising passing the fluid into a third flow channel bore in a third plate, regardless of the position of the second plate.

21. The method of claim 17, further comprising the offset occurring along the translation direction of the moving second plate.

22. The method of claim 17, further comprising deflecting the fluid into the second flow channel bore.

23. The method of claim 22, further comprising deflecting the fluid into the second flow channel bore using at least one feature selected from the group consisting of a ledge of the second plate, an entry port defined in the first flow channel bore, and combinations thereof.

24. An apparatus for metering flow in the continuous casting of molten metal including a metering gate, in which the metering gate comprises:

a refractory piece comprising a top plate and a first flow channel bore with an inlet having an inlet axis and an outlet having an outlet axis where the inlet axis and the outlet axis are offset; and a throttle plate slidably contacting the top plate and adapted for selectably receiving flow from the top plate.

25. The apparatus of claim 24, wherein the refractory piece comprises a monoblock.

26. The apparatus of claim 24, wherein the throttle plate includes a second flow channel bore, the throttle plate being translatable relative to the top plate along a translation direction generally orthogonal to a fluid flowable from the outlet of the first flow channel bore.

27. The apparatus of claim 26, wherein the throttle plate defines a ledge which deflects flow leaving the first flow channel bore, and the entry port and the ledge are adapted to cooperatively bend flow into the second flow channel bore.

28. The apparatus of claim 26, wherein the second flow channel bore is configured to expand fluid.

29. The apparatus of claim 26, wherein the second flow channel bore is an elongated, lofted bore.

30. An apparatus for metering flow in the continuous casting of molten metal comprising:

a first refractory piece comprising means for transporting a fluid in a first vertical direction and means for deflecting the fluid to a second vertical direction horizontally offset from the first vertical direction; and a throttle plate slidably contacting the first refractory piece and adapted for selectably receiving the flow from the first refractory piece.

* * * * *